US005408808A

United States Patent [19]

Masuda et al.

[11] Patent Number: 5,408,808

[45] Date of Patent: Apr. 25, 1995

[54] AUTOMATIC FULL-WEB STRETCH-WRAPPING APPARATUS

[75] Inventors: Tadao Masuda, Tokyo; Katsumi Hayakawa; Masahiro Tsukuda, both of Takatsuki; Hiroshi Iwasaki, Tokyo, all of Japan

[73] Assignee: Oji Seitai Kaisha, Ltd., Tokyo, Japan

[21] Appl. No.: 102,196

[22] Filed: Aug. 5, 1993

[30] Foreign Application Priority Data

Aug. 12, 1992 [JP] Japan ..... 4-235150
Sep. 18, 1992 [JP] Japan ..... 4-273406

[51] Int. Cl.[6] ..... B65B 11/00; B65B 53/00
[52] U.S. Cl. ..... 53/556; 53/587
[58] Field of Search ..... 53/556, 587, 211, 212, 53/374.2, 374.9; 100/15

[56] References Cited

U.S. PATENT DOCUMENTS 3,514,920 6/1970 Hoffler et al. .
4,077,179 3/1978 Lancaster et al. .
4,300,326 11/1981 Stackhouse ..... 53/587 X
4,413,463 11/1983 Lancaster .
4,514,955 5/1985 Mouser et al. ..... 53/587
4,662,151 5/1987 Mathes et al. ..... 53/587
4,779,396 10/1988 Stackhouse ..... 53/587 X
4,972,656 11/1990 Haugstad ..... 53/211 X
5,003,752 4/1991 Matsumoto ..... 53/587 X
5,161,349 11/1992 Lancaster et al. ..... 53/587 X

FOREIGN PATENT DOCUMENTS 53-11690 2/1978 Japan .
57-95302 6/1982 Japan .
59-52087 12/1984 Japan .
2224713 5/1990 United Kingdom ..... 53/211
80/01057 5/1980 WIPO .

*Primary Examiner*—Linda B. Johnson
*Attorney, Agent, or Firm*—Burns, Doane, Swecker & Mathis

[57] ABSTRACT

An automatic stretch-wrapping apparatus for wrapping a load, including empty PET bottles, with a stretchable film. The apparatus includes a turntable for placing the load thereon, and the stretchable film is supplied from a roll of stretchable film in a vertical position via film tensioning rollers to a gripper device. The gripper device is mounted on the turntable for gripping the leading end of the film and can rotate not only with the turntable but also relative to the turntable. Also, a swing arm device is arranged for movement toward and away from the gripper device to cooperate with the gripper device and includes pusher blades for pushing the film toward the gripping fingers of the gripper device, a heatsealer, and a cutter. It is possible to automatically wrap the load by the film in only one turn thereof.

23 Claims, 24 Drawing Sheets

AUTOMATIC FULL-WEB STRETCH-WRAPPING APPARATUS

BACKGROUND OF THE INVENTION

1. Field of the Invention

The present invention relates to an automatic full-web stretch-wrapping apparatus designed to wrap a load in a stretchable film, and in particular, it relates to an automatic full-web stretch-wrapping apparatus which includes a turntable to rotate a load thereon and a gripper arranged on the turntable for gripping the leading end of a film whereby the load is wound with one turn of stretchable film under tension.

2. Description of the Related Art

A known automatic stretch-wrapping apparatus includes a turntable having a conveyor for transferring a load to and from the apparatus to carry out all steps of winding or wrapping the load on the turntable by a stretchable film under tension while the turntable is rotated. There are two types of automatic stretch-wrapping apparatuses; one type is called a spiral winding type in which a narrow film is spirally wound around a load in a plurality of turns, as disclosed, for example, in Japanese Unexamined Utility Model Publication (Kokai) No. 57-95302; and the other type is called a full-web type in which a wide film having a width substantially equal to or greater than a height of a load to be wrapped so that the load is fully wrapped between the upper and lower edges of the film, as disclosed, for example, in Japanese Unexamined Patent Publication (Kokai) No. 53-11690.

Either of these two types includes a gripper for gripping the leading end of a stretchable film supplied from a roll, which gripper is mounted on the turntable at the side surface thereof so that the gripper can take, gripping position in which the gripping fingers of the gripper project above the upper surface of the turntable and grip the film and a releasing position in which the gripping fingers of the gripper retract below the upper surface of the turntable and release the film. The gripper is in the gripping position at the initial stage of the operation, and the turntable with the load is rotated by a certain angles greater than 360 degrees to wrap the load by the film so that the film is wound around the load in one plus a little more turns so that the second partial turn of the film overlaps the first turn of the film whereby the first turn of the film is fastened to the load by the second turn of the film. The gripper is then brought into the releasing position. The turntable is continuously rotated to wrap the load with a plurality of turns of the film. When the turntable is stopped, the gripper is again brought into the gripping position, and finally, the film of cling type is adhered to the load and cut between the load and the gripper, with the next leading portion of the film gripped by the gripper.

A problem arises in the prior art that the first turn of the film around the load is not stretched to function as a stretch-wrapping film because the leading end of the stretchable film (gripped by the gripper) is not securely fixed (e.g. by heatsealing) onto a portion of the film wrapped thereon and it is necessary to wind the film around the load in a plurality of turns. Therefore, the leading portion of the film is wasted even in the full-web type stretch-wrapping apparatus in the prior art.

Also, there is a pass through type stretch-wrapping apparatus, as disclosed in, for example, U.S. Pat. No. 4,413,463, which uses a wide film having a width greater than a height of a load to be wrapped so that the load is wound and tightened by one turn of the stretched film.

However, in this pass through type stretch-wrapping apparatus too, since the wrapping operation is carried out while the load is moving and it is not possible to arrange a so-called "top platen" which can be arranged in the above described stretch-wrapping apparatus having the turntable, there is a problem that a resistance of the stretched film may partially shift a light and high load, for example, comprising empty PET bottles stacked in a plurality of layers, deform its posture or disarrange the alignment of such palletized articles in the process of the load passing through the machine, i.e., in the stretch-wrapping step, although there may be a difference depending on the tensioning system imparting tension to the stretched film.

In addition, if the pass through type stretch-wrapping apparatus is to be used in place of the conventionally used stretch-wrapping apparatus having the turntable, it is necessary to change the layout of the entire automatic wrapping line due to the difference of the dimensions of the stretch-wrapping apparatuses, and an extra investment in installation will be necessary.

SUMMARY OF THE INVENTION

The object of the present invention is to solve the above described problem and to provide an automatic full-web stretch-wrapping apparatus which includes a turntable having a conveyor for transferring a load to be wrapped to and from said apparatus and in which a stretchable film having a width greater than the height of the load to be wrapped can be used so that the load is wound and tightened by one turn of the stretching film while the turntable is rotated one revolution.

Another object of the present invention is to provide a an automatic full-web stretch-wrapping apparatus designed to handle a load having dimensions similar to that of a load handled in the conventional automatic stretch-wrapping apparatus and which can be used in a layout similar to that used with the conventional automatic stretch-wrapping apparatus.

According to the present invention, there is provided an automatic stretch-wrapping apparatus comprising a base frame, a turntable arranged on the base frame for rotation about a first vertical axis, the turntable having a conveyor for transferring a load to be wrapped to and from the apparatus, a film-support frame arranged on the base frame adjacent to the turntable, the support frame having means for supporting a roll of stretchable film in a vertical position and film tensioning means, a gripper means arranged on the turntable at a relatively outer region of the turntable and comprising at least a pair of cooperating gripping fingers for gripping therebetween an end of the film supplied from the roll of film via the film tensioning means so that the film gripped by the gripper means is wound around a load on the turntable while the turntable with the gripper means rotates around the first axis, the gripper means being rotatable on the turntable about a second axis parallel to the first axis, and swing arm means pivotally supported about a third axis parallel to the first axis for movement toward and away from the gripper means. The swing arm means includes pusher means for pushing the film toward the gripping fingers of the gripper means, heatsealer means for heatsealing a leading portion of the film wound around the load with another portion of the film, and cutting means for cutting the film between the gripping fingers and the heatsealer means.

With this arrangement, the load can be held by a top platen to stabilize the load as desired. The upright gripper means arranged on the turntable at a relatively outer region of the turntable grips the leading-end portion of the film, and is first rotated by 360 degrees relative to the turntable, and then the turntable with the gripper means is rotated one revolution. Therefore, the stretchable film, in tension, is wound around the load in one turn.

Then the swing arm means is actuated toward the gripper means after the turntable is stopped. The the swing arm means cooperates with the gripper means, preferably guide rollers of the swing arm means engage with the antislip portions of the gripper means, to hold the film therebetween, to allow the gripping fingers of the gripper means to release the film. The cutting means cuts the film, and the heatsealer means heatseals the leading end of the film and the cut trailing end of the film. The pusher means pushes the cut leading end of the film which becomes the leading end of the film in the next cycle toward the gripper means so as to allow the gripping fingers of the gripper means grip the film. Then the swing arm means is moved away from the gripper means and the cycle is completed. In this way, in the automatic stretch-wrapping apparatus according to the present invention, the stretchable film in tension is wound around the load in one turn, to thereby tighten the load.

BRIEF DESCRIPTION OF THE DRAWINGS

The other objects and advantages of the present invention will become apparent from the following description of the preferred embodiments, with reference to the accompanying drawings, in which.

DESCRIPTION OF THE PREFERRED EMBODIMENTS

Figure 1:
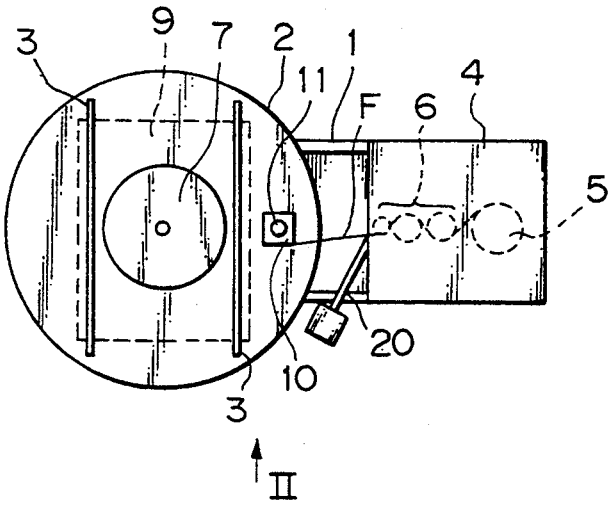
FIG. 1 is a top plan view of an automatic stretch-wrapping apparatus according to the first embodiment of the present invention.
Figure 2:
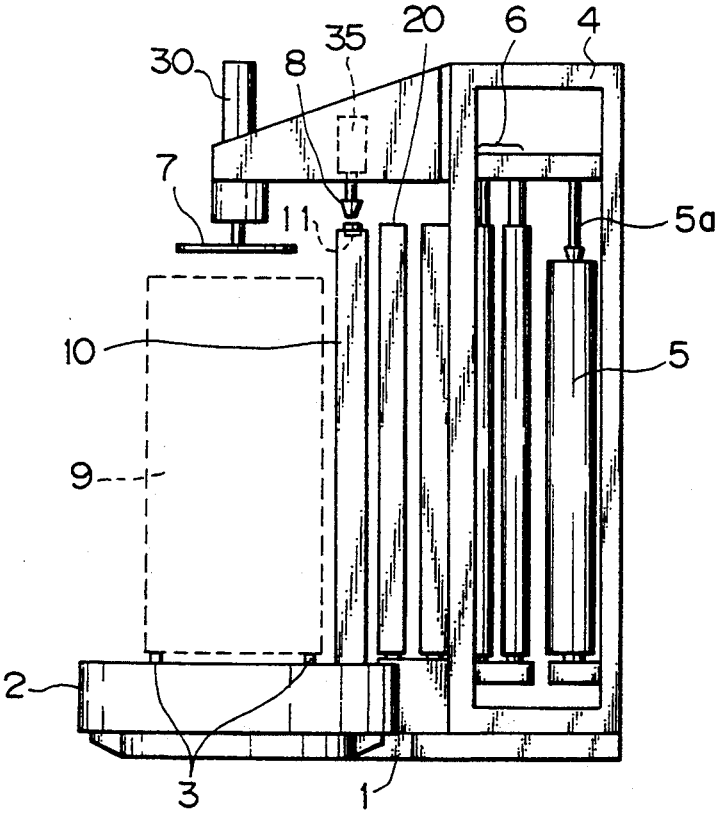
FIG. 2 is a side view of the apparatus of FIG. 1, viewed from the arrow II in FIG. 1.

FIGS. 1 and 2 show the first embodiment of the present invention, in which the automatic stretch-wrapping apparatus comprises a base frame 1, a turntable 2 arranged on the base frame 1, a film support frame 4 arranged on the base frame 1 adjacent to the turntable 2, and a swing arm device 20 pivotally arranged on the base frame 1. In addition, a gripper device 10 is rotatably arranged on the turntable 2 at a relatively outer region of the turntable 2.

Figure 4:
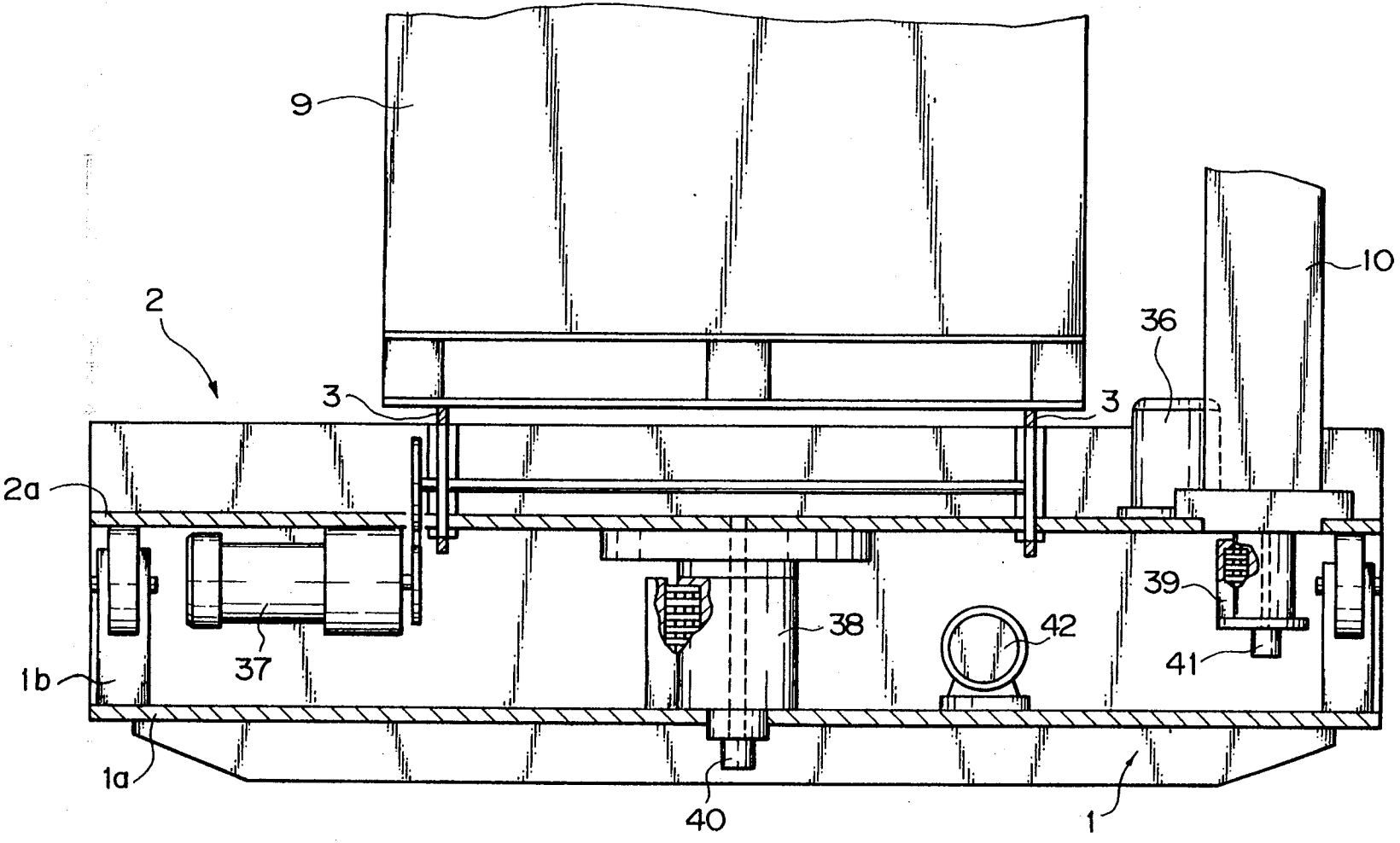
FIG. 4 is an enlarged vertical cross-sectional view of the turntable and the gripper device of FIG. 1.

As shown in FIG. 4, the base frame 1 has a support plate 1*a*, and the turntable 2 has a bottom plate 2*a* rotatably supported by the support plate 1*a* of the base frame 1 via caster wheel assemblies 1*b* mounted to on the support plate 1*a*. An electric motor 42 is arranged on the support plate la and operatively connected to the turntable 2 by a not-shown transmission mechanism to rotationally move the turntable 2. The turntable 2 has a chain conveyor 3 for transferring a load 9 to be wrapped to and from the apparatus.

Figure 19:
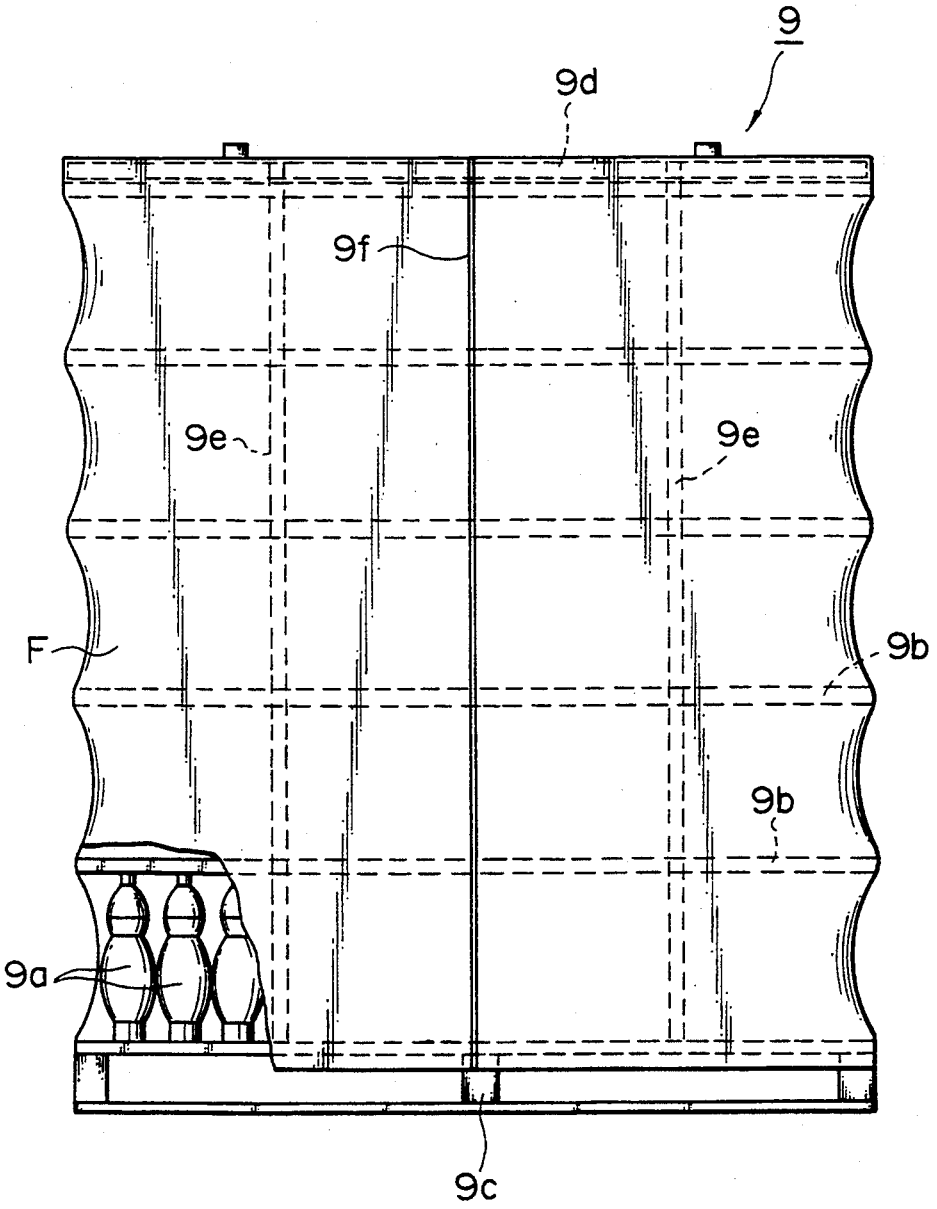
FIG. 19 is a partial view of the load stretch-wrapped by the film according to the present invention.

The load 9 may be a palletized and stretch-wrapped load, as shown in FIG. 19, which is comprised of a plurality of articles such as empty PET bottles 9*a* palletized on a pallet 9*c*. The articles 9*a* are placed on the pallet 9*c* in bulk via separate sheets 9*b*. A top board 9*d* is placed on the top of the load 9 and straps 9*e* are applied to the load 9. FIG. 19 shows the load 9 stretch-wrapped by a stretchable film F, the stretch-wrapping being the subject of the present invention. The film F has a width (corresponding a height in FIG. 19) greater than the height of the load 9, so that the load 9 is fully wrapped along the height thereof in one turn of the film F. The film may have a width substantially equal to or a little greater than a height of the load 9. A vertical sealing portion 9*f* of the film F is shown in FIG. 19.

Figure 15:
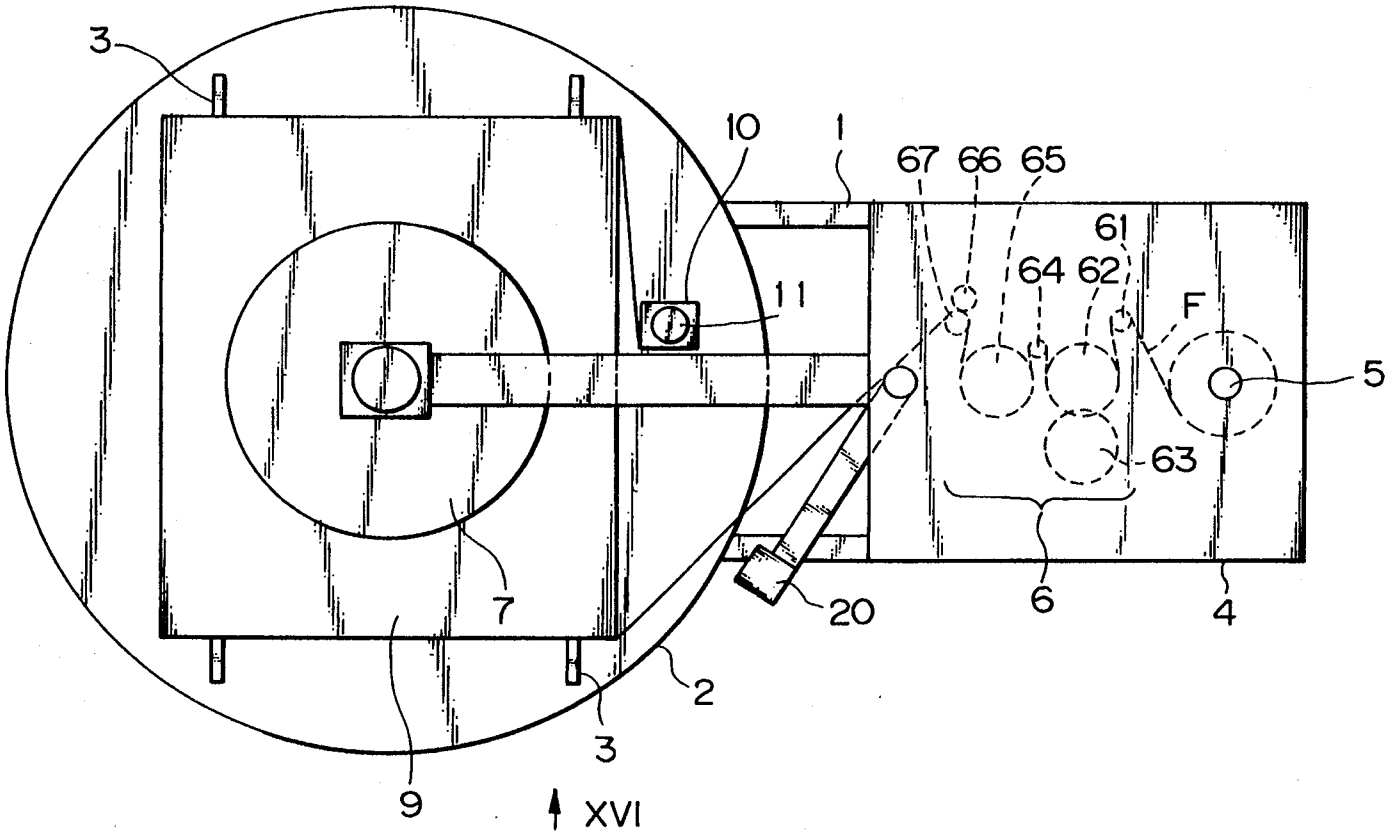
FIG. 15 is a top plan view of an automatic stretch-wrapping apparatus according to the second embodiment of the present invention.
Figure 16:
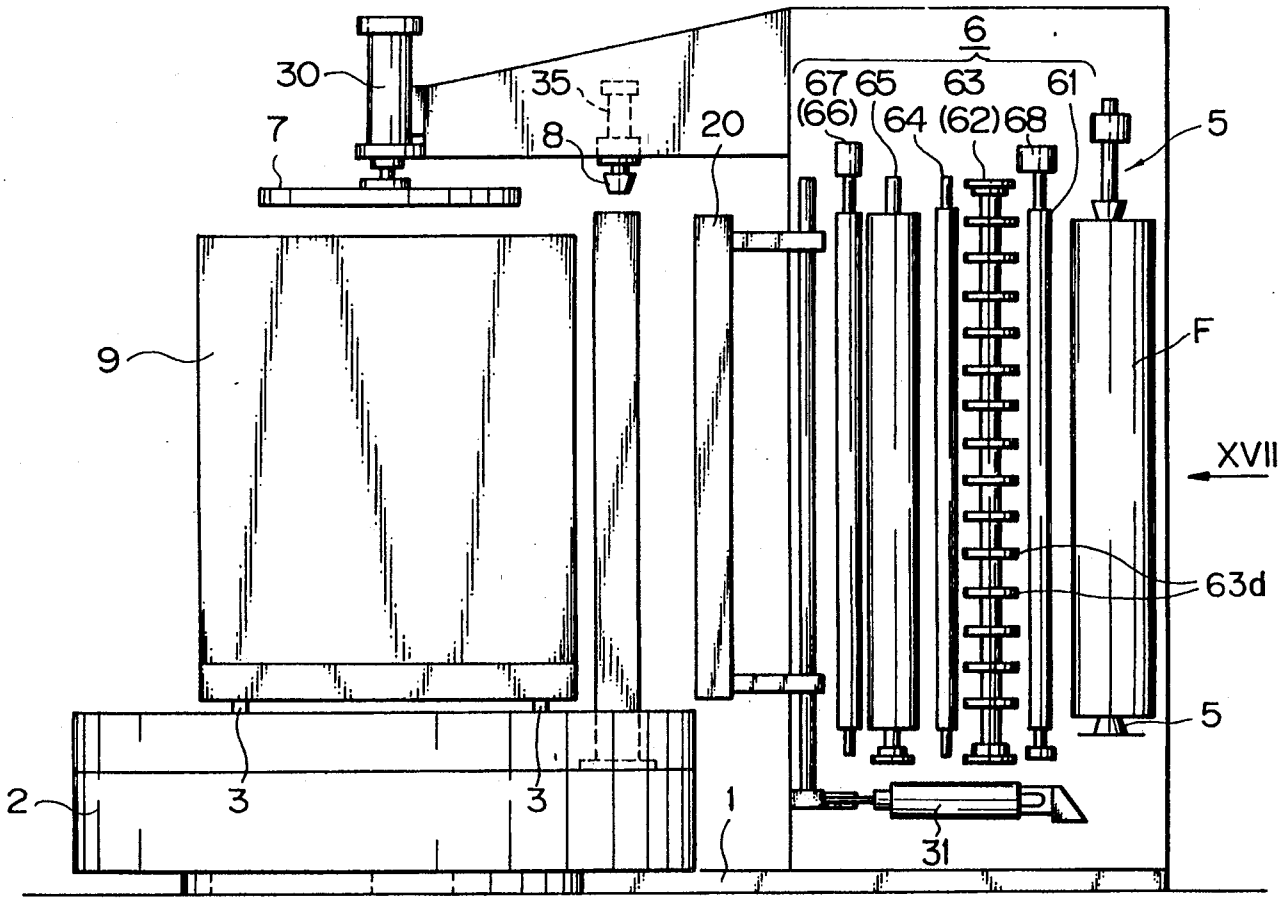
FIG. 16 is a side view of the apparatus of FIG. 15, viewed from the arrow XVI of FIG. 15.
Figure 17:
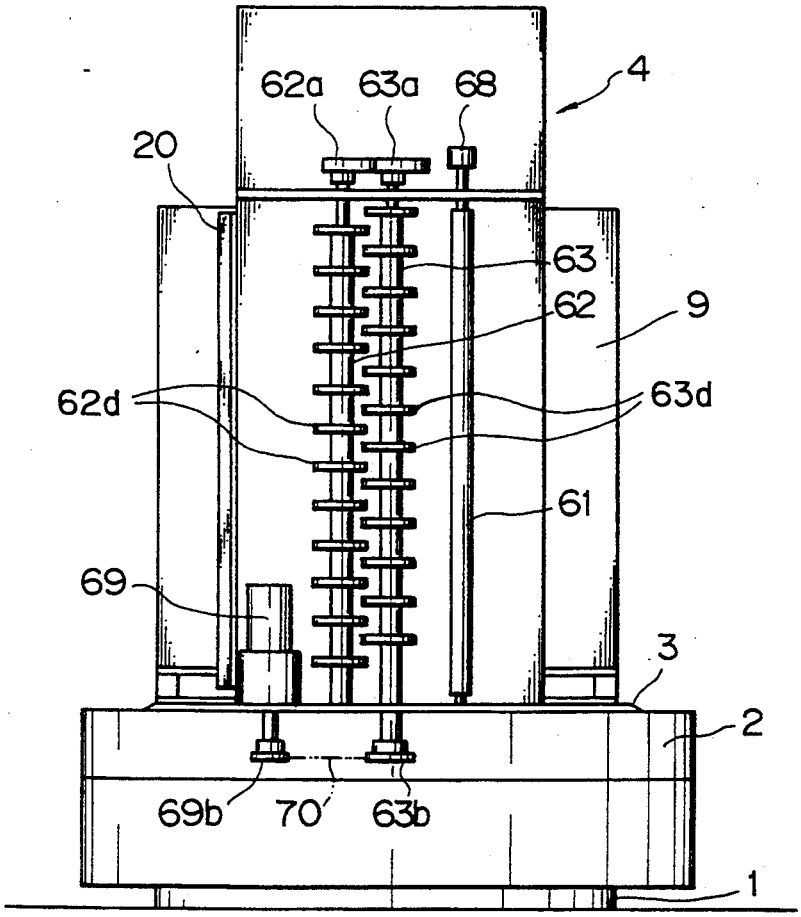
FIG. 17 is a rear side view of the apparatus of FIG. 16, viewed from the arrow XVII of FIG. 16.
Figure 18:
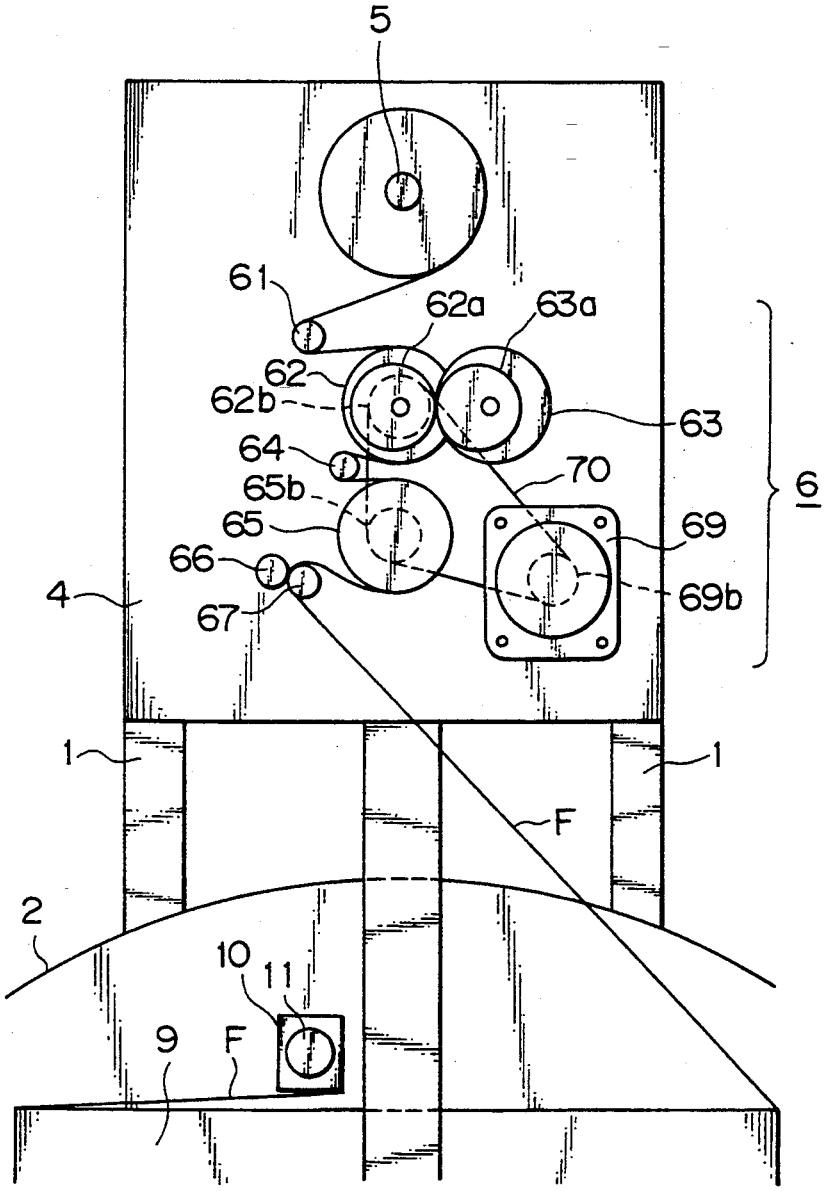
FIG. 18 is an enlarged view of a portion the apparatus of FIG. 15, with the top platen of the film support frame removed.

As shown in FIGS. 1 and 2, the film support frame 4 has means such as a shaft 5*a* for supporting a roll 5 of stretchable film F in a vertical position. The film F has a width described above. The film support frame 4 also has film tensioning means 6 comprising a driven roller prestretching mechanism comprising at least two rollers driven at different peripheral speeds from each other to stretch the film F between the rollers, i.e., the downstream roller is driven faster than the upstream roller. It is possible to constitute the film tensioning means 6 from a brake roller incorporating a magnetic brake (brake roller is shown in FIG. 15, for example).

The film support frame 4 also has a top platen 7 located above the turntable 2 for upward and downward movement to engage with the load 9 on the turntable 2 to hold the load 9. The top platen 7 is actuated by a pneumatic cylinder 30 for upward and downward movement. The film support frame 4 also has a locking taper cone 8 above the gripper device 10 for upward and downward movement to engage with the taper cavity on the top of the gripper device 10. The locking taper cone 8 is actuated by a pneumatic cylinder 35 for upward and downward movement.

As shown in FIG. 4, the gripper device 10 is rotatably arranged on the turntable 2 around the second central axis of the gripper device 10. To this end, an electric motor 36 is arranged on the turntable 2 to actuate the gripper device 10, the electric motor 36 being of the type what includes a reduction gear device and a brake. Also, an electric motor 37 including a reduction gear device and a brake is arranged on the turntable 2 to actuate the conveyor 3.

A slip ring 39 is attached to the lower portion of the gripper device 10 to electrically connect electrical components on the turntable 2 to electrical components on the gripper device 10, and a rotary joint 41 is attached to the lower portion of the gripper device 10 to connect a pipe on the turntable 2 to a pipe on the gripper device 10. In addition, a slip ring 38 is attached to the lower portion of the base frame 1 to electrically connect electrical components on the base frame 1 to electric components on the turntable 2, and a rotary joint 40 is attached to the lower portion of the turntable 2 to connect a pipe on the base frame 1 to a pipe on the turntable 2. Accordingly, the components on the turntable 2 and on the gripper device 10 can be electrically and pneumatically actuated while the turntable 2 and on the gripper device 10 are rotating, respectively.

Figure 3:
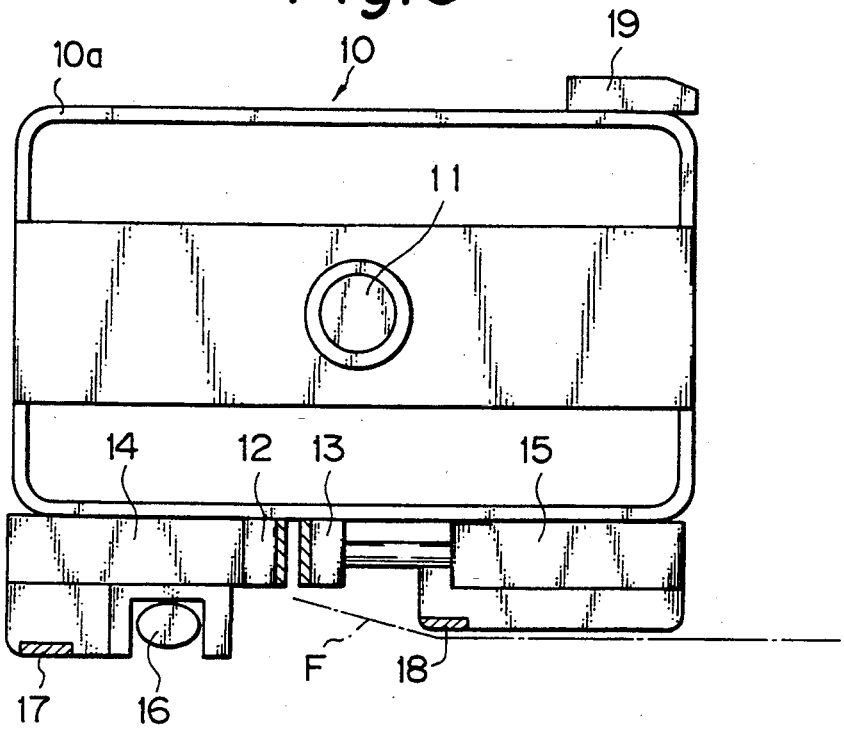
FIG. 3 is an enlarged top plan view with a partial cross-section of the gripper device of FIG. 1.
Figure 5:
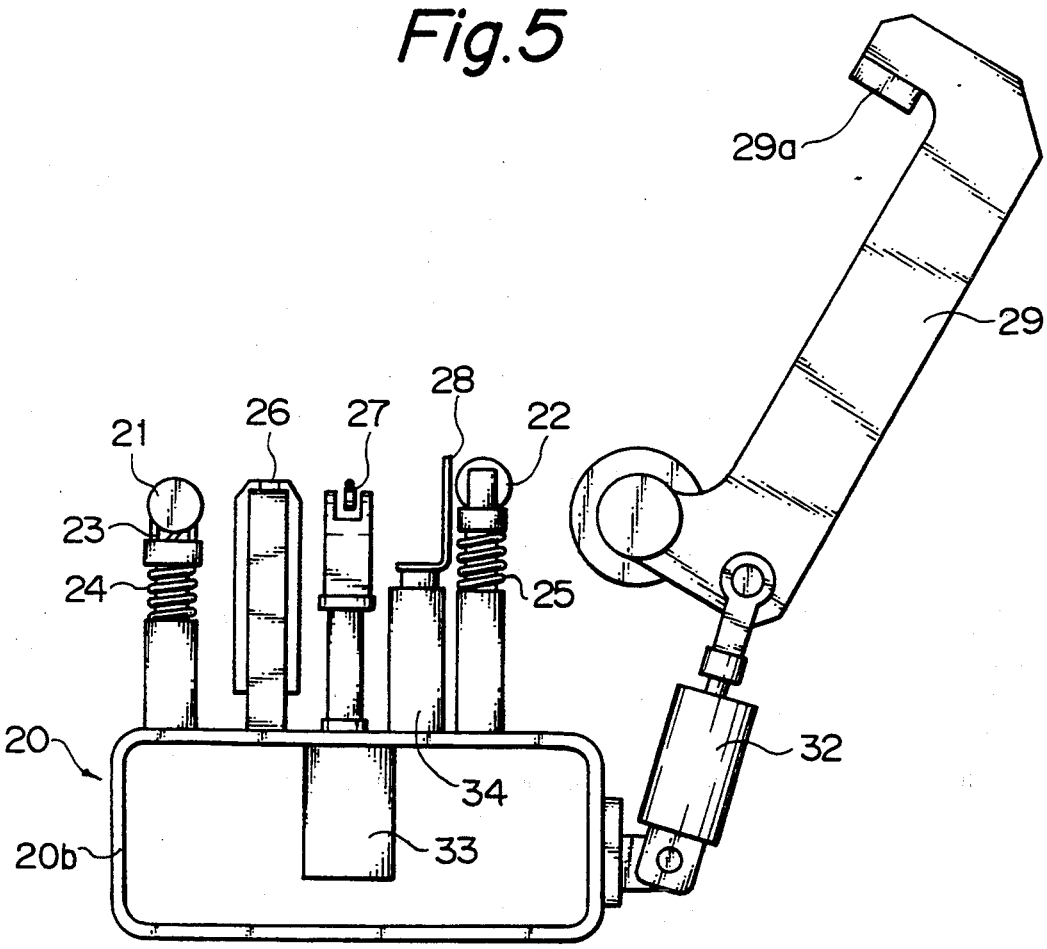
FIG. 5 is an enlarged top plan view of a portion of the swing arm device of FIG. 1.
Figure 6:
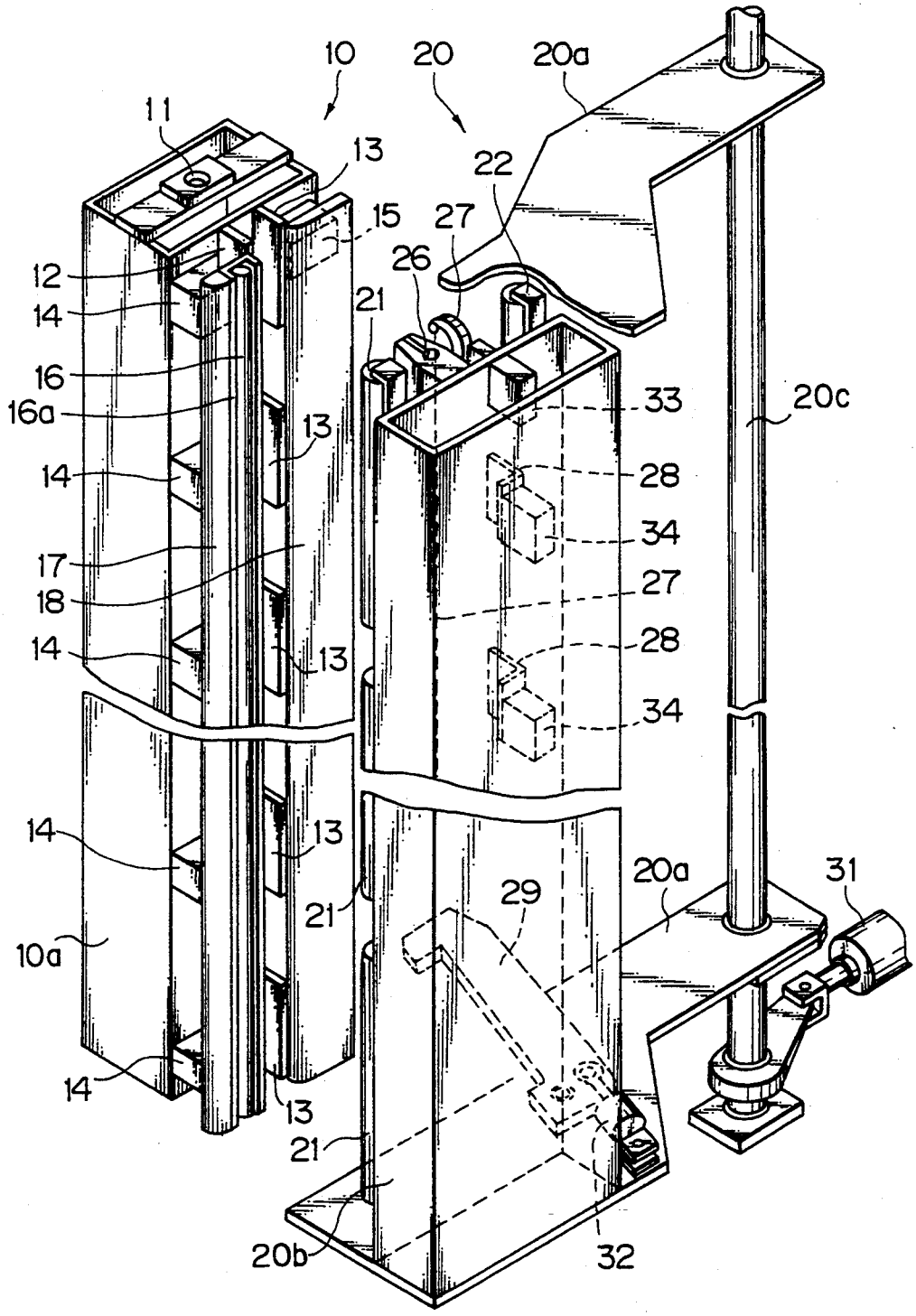
FIG. 6 is a perspective view of the gripper device and the swing arm device.

The details of the gripper device 10 and the swing arm device 20 are shown in FIGS. 3, 5 and 6. As shown in FIGS. 3 and 6, the gripper device 10 includes a vertically extending post 10a with a rectangular cross-sectional shape having a front surface, side surfaces and a back surface. The front surface is directed to the swing arm device 20 when the latter is moved toward the gripper device 10, i.e., the front surface is that viewed from the arrow II in FIG. 1.

The gripper device 10 has at the front surface thereof at least a pair of cooperating gripping fingers 12 and 13 for receiving therebetween the leading end of the film F supplied from the roll 5 via the film tensioning means 6. The gripping fingers 12 and 13 can grip a leading edge of the film F along the full width of the film F. In the preferred embodiment, the gripper device 10 has at the front surface thereof a plurality of pairs of cooperating gripping fingers 12 and 13 so that the gripping fingers 12 and 13 of each pair are in a horizontally opposite relationship and the pairs 12 and 13 are in a vertical row.

The gripping fingers 12 and 13 of each pair are horizontally movable toward and away from each other and actuated by pneumatic cylinders 14 and 15, respectively, and thus each of the gripping fingers 12 and 13 is movable between a first position and a second position. In FIG. 2, the gripping fingers 12 and 13 are in the first (left) position, and in FIG. 6, the gripping finger 12 is in the first (left) position and the gripping finger 13 is in the second (right) position.

The gripping fingers 12 and 13 are arranged at the horizontally central region of the front surface of the post **10*a* of the gripper device 10. A backup member for the heatsealer in the form of a vertically extending air tube 16 is arranged at the the front surface of the post 10*a* of the gripper device 10 on the side of the gripping fingers 12 and 13 near the center of the turntable 2 to receive and cooperate with a heatsealer 26 arranged on the swing arm device 20 to heatseal the film F between the heatsealer 26 and the air tube 26. The air tube 26 extends vertically parallel to the row of gripping fingers 12 and 13**.

The gripper device 10 also includes at the front surface thereof a first antislip portion 17 vertically extending on the outer side of the air tube 26 remote from the gripping fingers 12 and 13, a second antislip portion 18 vertically extending on the outer side of the gripping fingers 12 and 13 remote from the air tube 26.

As shown in FIGS. 5 and 6, the swing arm device 20 comprises upper and lower swing arms **20*a* fixedly supported by a vertical shaft 20*c* which is rotationally actuated by a pneumatic cylinder 31. It will be appreciated that the first central axis of the turntable 2, the second central axis of the gripper device 10, and the third pivot axis of the swing arm device 20** extend vertically and parallel to each other.

A vertically extending post **20*b* is supported by the upper and lower swing arms 20*a* and thus can be moved toward and away from the gripper device 10. The post 20*b* has a front surface directed to the front surface of the gripper device 10. The post 20*b* has, at the front surface, vertically spaced pusher blades 28 for pushing the film F toward the gripping fingers 12 and 13 of the gripper device 10. The pusher blades 28 are arranged vertically between two adjacent pairs of the gripping fingers 12 and 13 and horizontally between the opposite gripping fingers 12 and 13 of each pair, respectively, when the pusher blades 28, with the swing arm device 20, are moved toward the gripper device 10. The pusher blades 28 are actuated by a pneumatic cylinder 34. Accordingly, the film F can be pushed between the opposite gripping fingers 12 and 13 of each pair by the pusher blades 28, allowing the opposite gripping fingers to move 12 and 13** toward each other.

The impulse heatsealer 26 is also arranged on the front surface of the post **20*b* of the swing arm device 20 to cooperate with the air tube 16 of the gripper device 10. The air tube 16 normally shrinks and is inflated to cooperate with the heatsealer 26, when the heatsealer 26 is supplied with a current. A hot wire cutter 27 is arranged between the pusher blades 28 and the heatsealer 26 for cutting the film F. The cutter 27 is actuated by a pneumatic cylinder 33**.

In addition, a first row of vertically extending guide rollers 21 are arranged on the front surface of the swing arm device 20 on the outer side of the heatsealer 26 remote from the pusher blades 28 for engagement with the first antislip portion 17, and a second row of vertically extending guide rollers 22 are arranged on the front surface of the swing arm device 20 on the outer side of the pusher blades 28 remote from the heatsealer 26 for engagement with the second antislip portion 18. The guide rollers 21 and 22 are urged towards the antislip portions 17 and 18 by springs 24 and 25, respectively. The guide rollers 21 and 22 first engage with the antislip portions 17 and 18, respectively, when the swing arm device 20 is moved toward the gripper device 10 to hold the film F between the guide rollers 21 and the antislip portion 17 and between the guide rollers 22 and the antislip portion 18.

Further, a chuck receiving member 19 is arranged at the bottom of the gripper device 10, and a chuck 29 having an engaging pad **29*a* is arranged at the bottom of the swing arm device 20. The chuck 29 is pivotally actuated by a pneumatic cylinder 32 so that the engaging pad 29*a* engages with the chuck receiving member 19 to lock the swing arm device 20 relative to the gripper device 10 when the swing arm device 20 is moved toward the gripper device 10**.

Each of the first guide rollers 21 on the downstream side is constructed to cooperate with a brake shoe 23 so that the first guide roller 21 immovably holds the film F when the swing arm device 20 is moved toward the gripper device 10. Each of the second guide rollers 22 on the upstream side includes a ratchet by which second guide roller 22 can rotate in one direction only to allow the film F to move in the direction from the tensioning means 6 to the gripper device 10.

The operation of the automatic stretch-wrapping apparatus according to the present invention will be described with reference to FIGS. 1, 2, 7A to 7H, and 8 to 14.

As shown in FIG. 1, the gripper device 10 is arranged on the turntable 2 at a relatively outer region thereof at a position substantially on a line connecting the first central axis of the turntable 2 and the film tensioning means 6 when the turntable 2 is in its initial position turntable 2. The front surface of the gripper device 10 extends generally parallel to said line when the turntable 2 is in its initial position and the gripper device 10 is in its initial position. Accordingly, the film F extending from the tensioning means 6 and gripped by the gripper device 10 initially rests on the front surface.

The conveyor 3 is actuated to start to receive a load 9 when a transferring signal from an apparatus on the upstream side is received, and is automatically stopped by an output of an appropriate sensor such as a beam switch (not shown) when the load reaches the center of the turntable 2. The top platen 7 is moved downwardly by the actuation of the pneumatic cylinder 30 to press the load 9.

At the beginning of the operation, the gripper device 10 is gripping the leading end of the film F along the full length of the film F, and the swing arm device is in the position away from the gripper device 10.

Figure 7A:
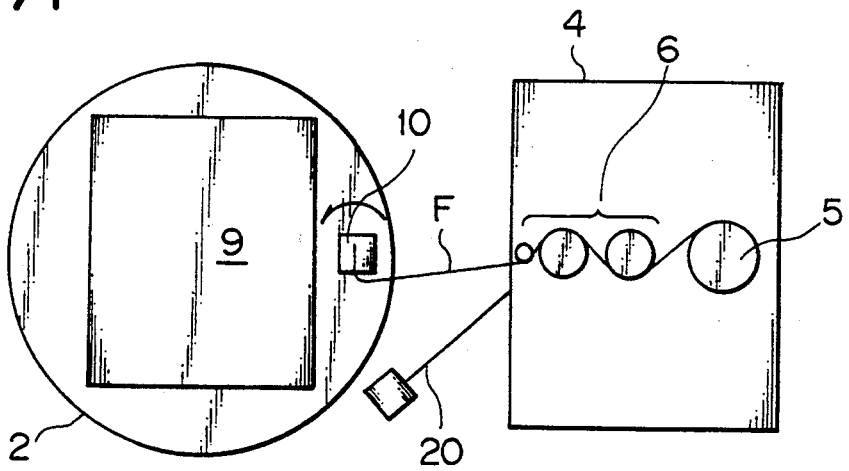
FIGS. 7A to 7H are views illustrating the sequential operation of the device of FIGS. 1 to 6.
Figure 7B:
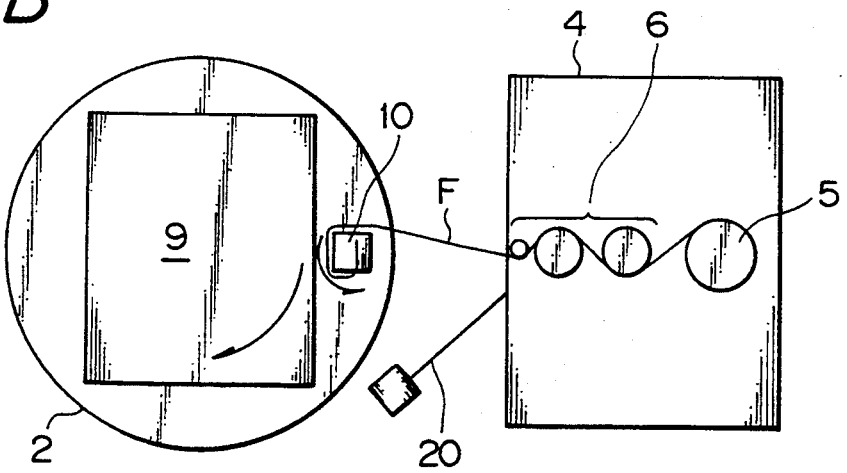
Figure 7C:
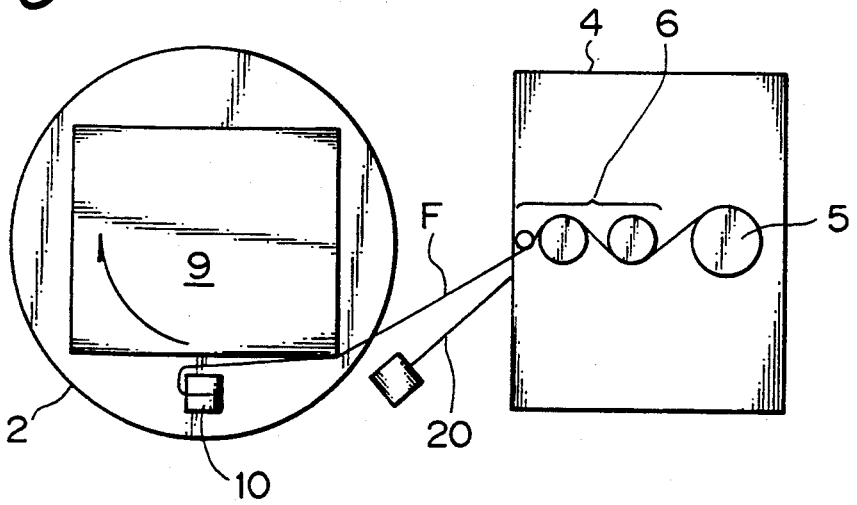
Figure 7D:
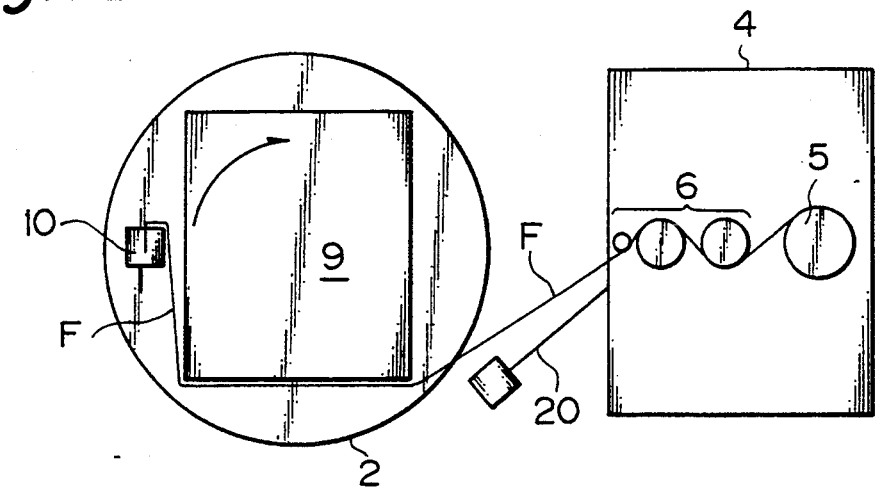
Figure 7E:
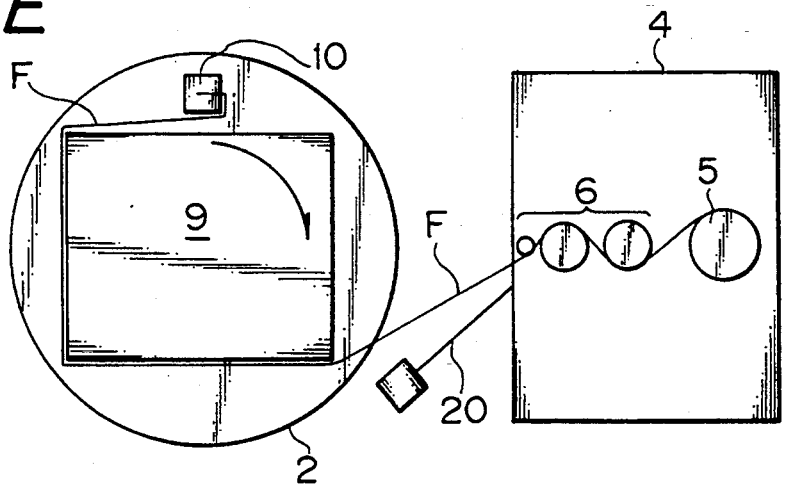

The gripper device 10 is initially rotated relative to the turntable 2 about the second central axis by 360 degrees from the initial position of the gripper device 10 by the actuation of the motor 36, as shown in FIG. 7A. The gripper device 10 is stopped at the position of FIG. 7B after the rotation of 360 degrees. In this condition, the film F rests on the front surface, one of the side surfaces near the first central axis (i.e., near the load 9), and the back surface of the post 10*a* of the gripper device 10. This means that the gripper device 10 is located inside a loop of the film F which will be unwound when the film is wound around the load 9.

Figure 7F:
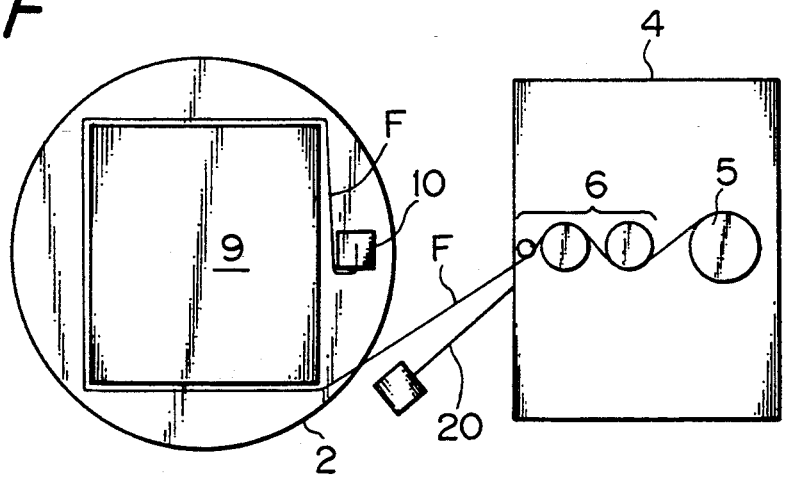

The turntable 2 is then rotated about the first central axis by 360 degrees to cause the film F to be wound around the load 9, as shown in FIGS. 7B to 7F, and is stopped in the position of FIG. 7F. With the rotation of the turntable 2, the gripper device 10 is rotated with the turntable 2 to cause the stretching film F to be wound around the load 9, the film being unrolled from the roll 5 of film, and stretched by the film tensioning means 6. Preferably, the speed of the film F supplied by the film tensioning means 6 is slightly faster than the speed of the film F pulled by the load (for example, refer to French Patent No. 2281275). During the rotation of the turntable 2, the film F rests on the side surface of the gripper device 10 near the load 9, as shown in FIGS. 7C to 7F, and thus the gripper device 10 is positioned outside the loop of the film F formed around the load 9.

Figure 7G:
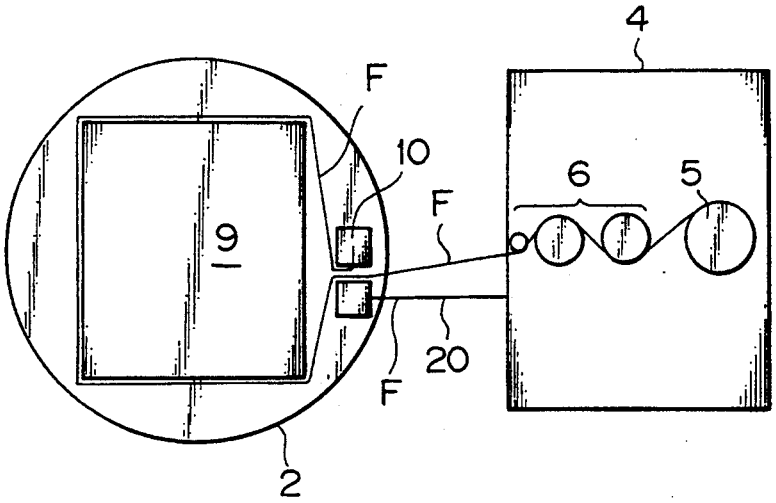

When the turntable 2 is stopped after one revolution, as shown in FIG. 7F, the locking taper cone 8 is moved downwardly by the actuation of the pneumatic cylinder 35, to engage in the taper cavity 11 on the top of the post 10*a* of the gripper device 10 to fix the gripper device 10 in position. The swing arm device 20 is then pivotally moved toward the gripper device 10 by the actuation of the pneumatic cylinder 31, as shown in FIG. 7G and the chuck 29 is engaged with the chuck receiving member 19 to lock the swing arm device 20 relative to the gripper device 10.

Figure 8:
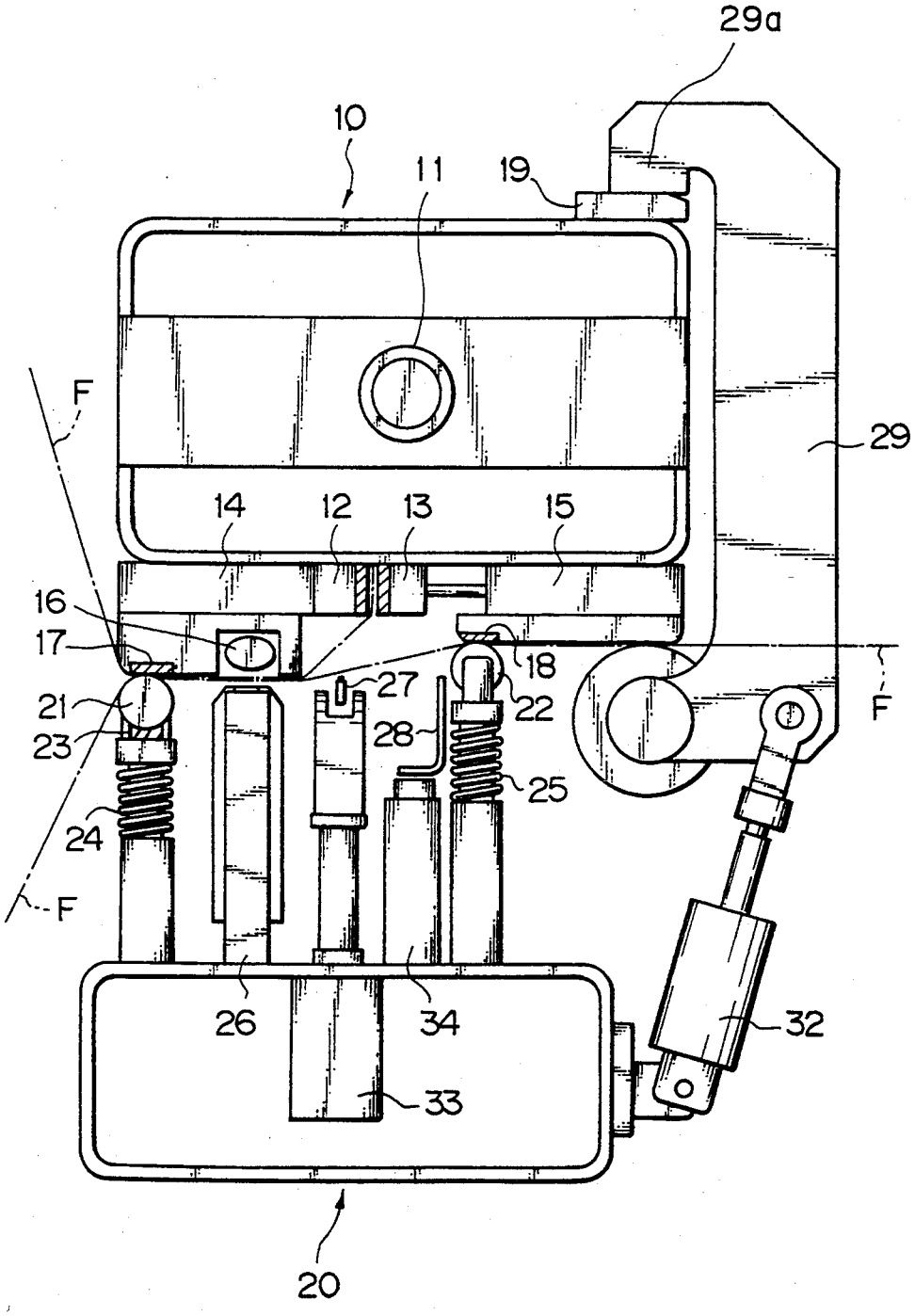
FIGS. 8 to 14 are views illustrating the sequential operation of the elements of the gripper device and the swing arm device.

This condition is shown in FIG. 8 in greater detail. In FIG. 8, the leading end of the film F (the leading end of the loop of the film F wound around the load 9) is gripped by the gripping fingers 12 and 13 of the gripper device 10, which are in the first (left) position. The trailing end of the loop of the film F wound around the load 9 is held between the guide rollers 21 and 22 of the swing arm device 20 and the antislip portions 17 and 18 of the gripper device 10, as described above, so that the film does not move. The air tube 16 is not yet inflated with air at this stage and so the impulse heatsealer 26 is not pressed to the film F, and the impulse heatsealer 26 is not yet supplied with a current. The hot wire cutter 27 and the pusher blades 28 are in the retracted, non-operative positions, respectively.

Figure 9:
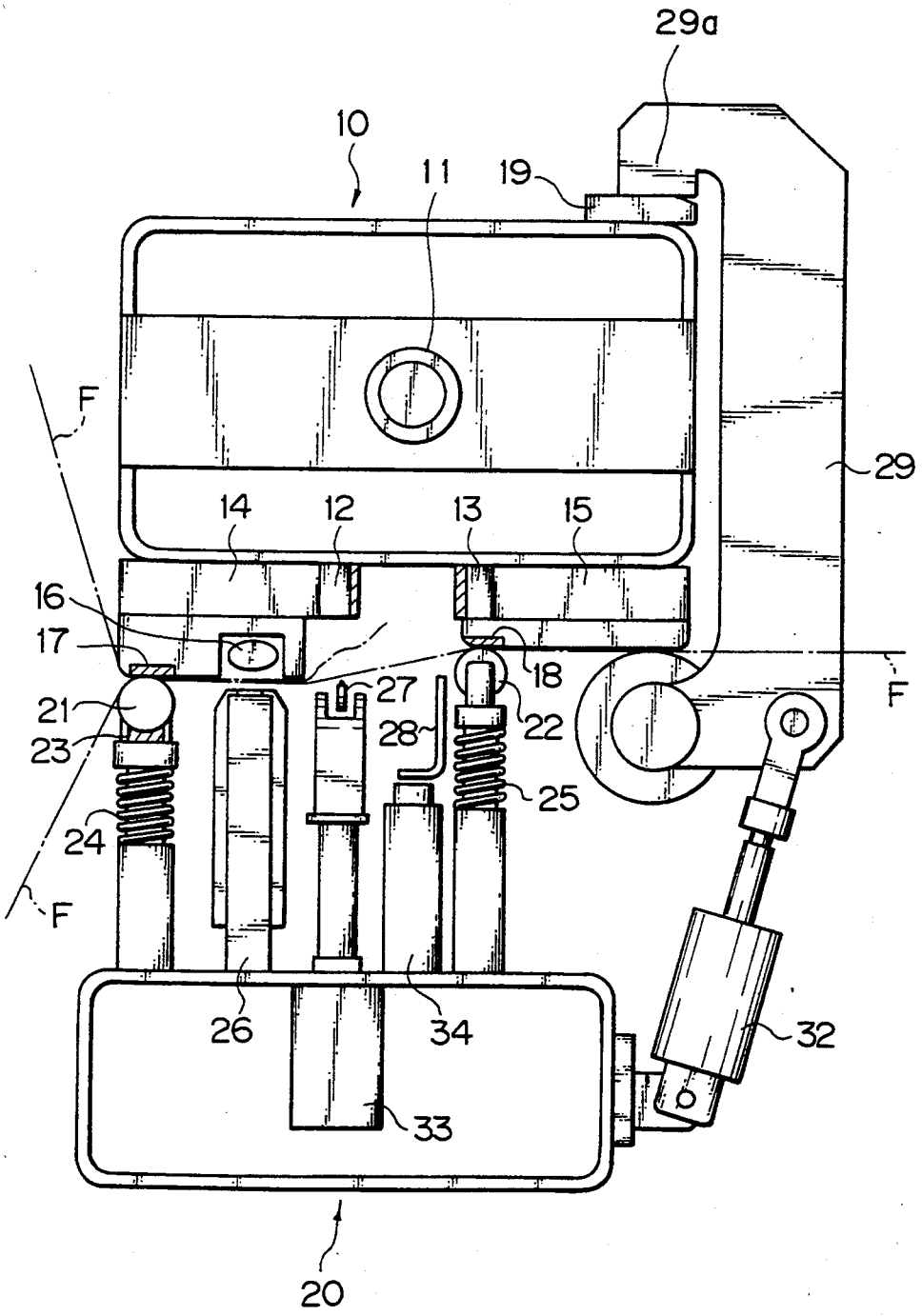
Figure 10:
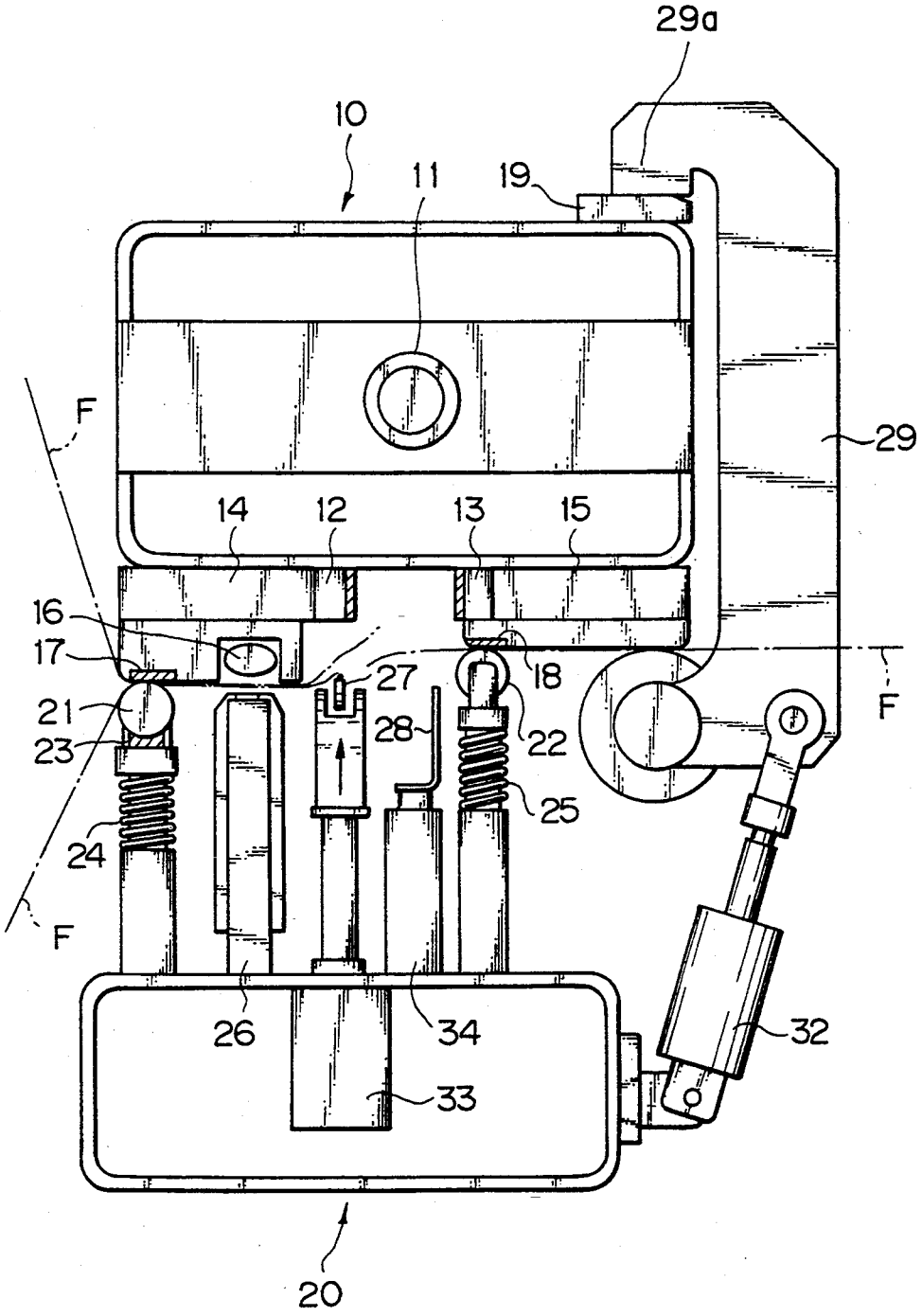

The gripping finger 13 is then moved to the second (right) position by the actuation of the pneumatic cylinder 15 to release the leading end of the film F, as shown in FIG. 9. The hot wire cutter 27 is then supplied with a current and advanced toward the film F by the actuation of the pneumatic cylinder 33 to cut the film F, as shown in FIG. 10. Immediately after the film F is cut, the hot wire cutter 27 is retracted to the initial position and the supply of the current is stopped. One portion of the cut film F is held between the guide rollers 21 and the antislip portion 17, and the other portion of the cut film F is held between the guide rollers 22 and the antislip portion 18.

Figure 11:
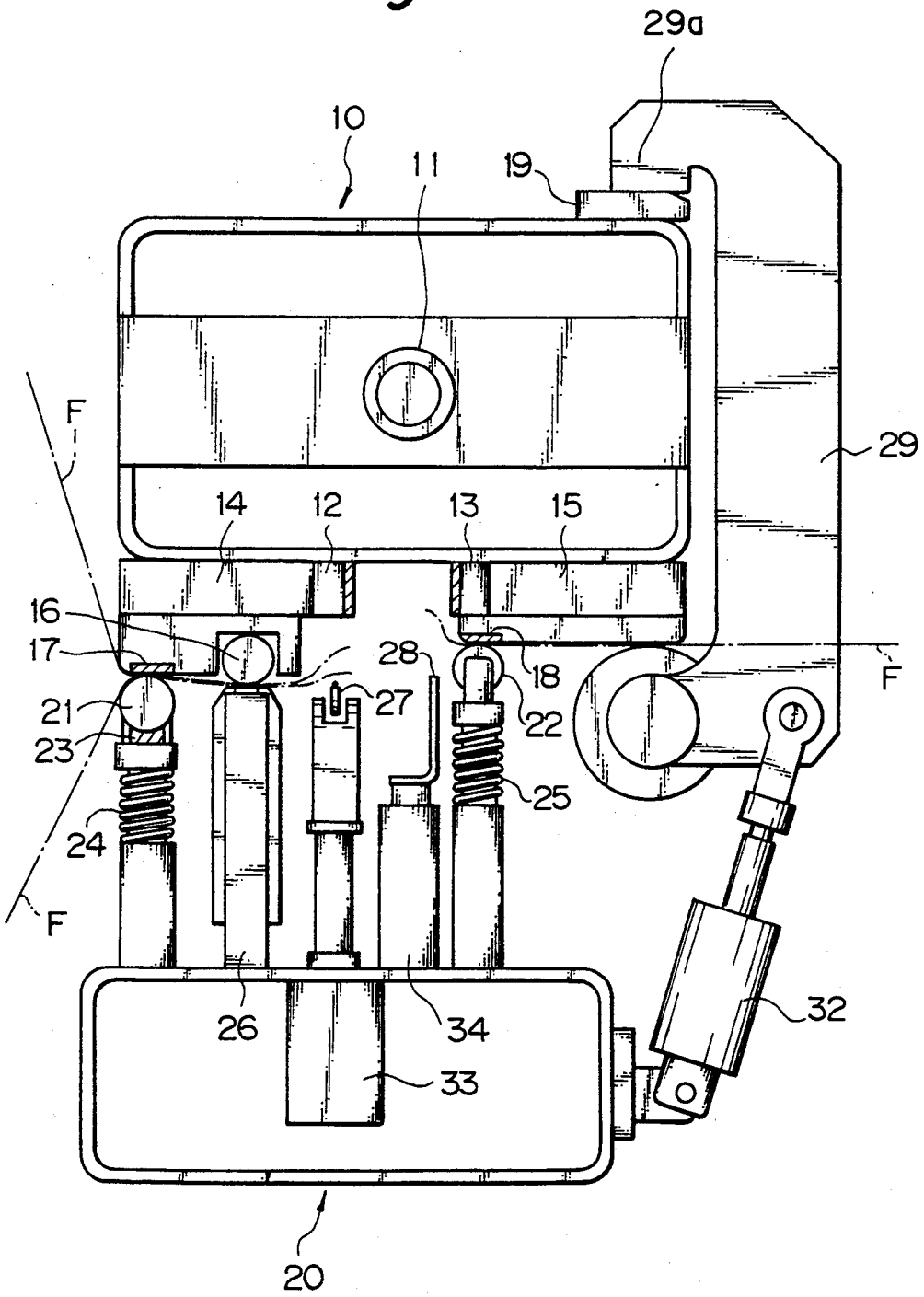

The air tube 16 is then inflated with air so that the film F is pressed to the impulse heatsealer 26 by the air tube 16, and the impulse heatsealer 26 is supplied with a current, to heatseal the leading end of the loop of the film F wound around the load 9 and the trailing end of the loop of the film F together, as shown in FIG. 11.

Figure 12:
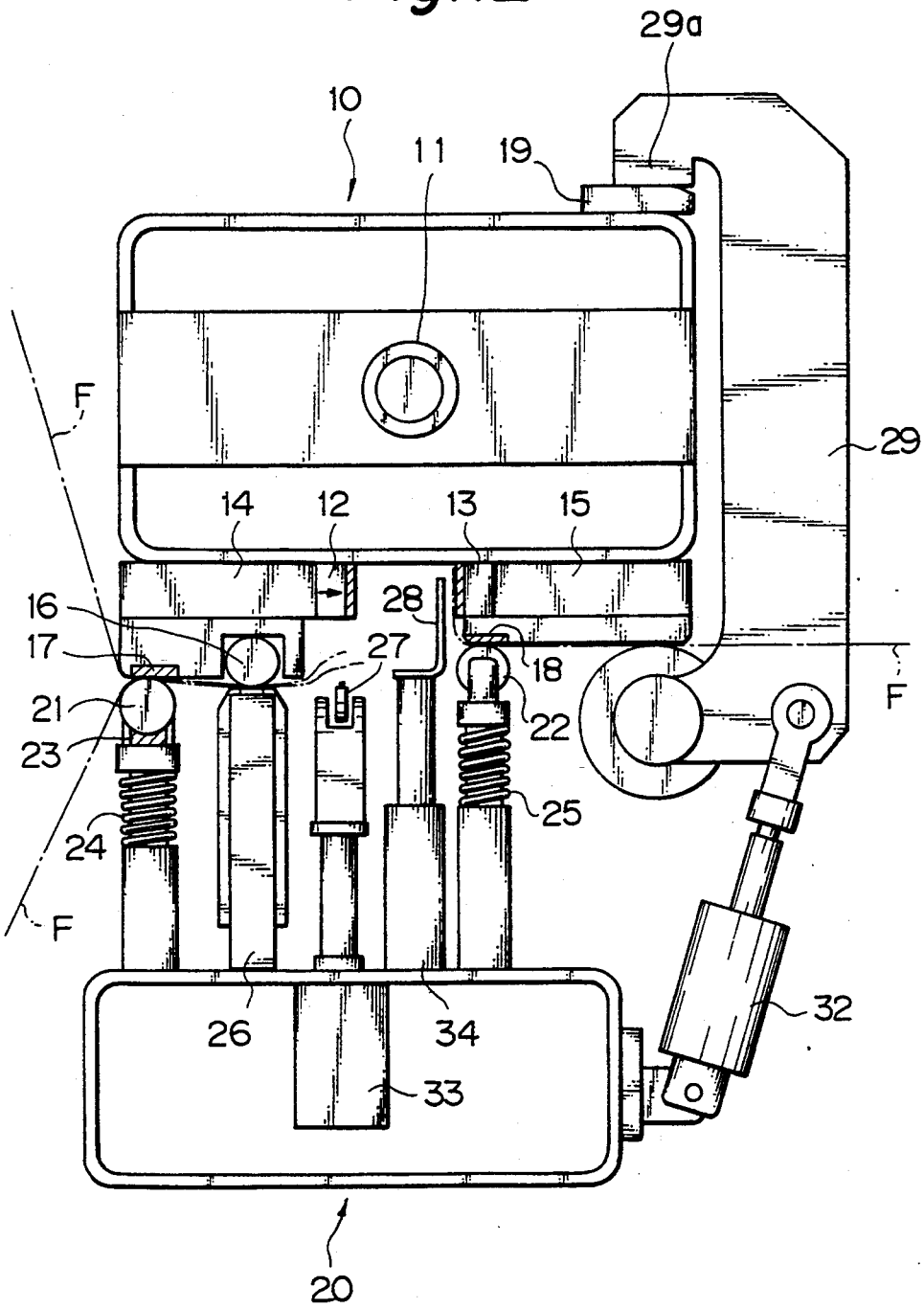

The pusher blades 28 are then advanced toward a position between the gripping fingers 12 and 13 of each pair (close to the gripping finger 13 in the second position) and between vertically adjacent two pairs of the gripping fingers 12 and 13 by the actuation of the pneumatic cylinder 34, to push a free end of the portion of the film F which is held between the guide roller 22 and the antislip portion 18 into a gap between the gripping fingers 12 and 13, as shown in FIG. 12.

Figure 13:
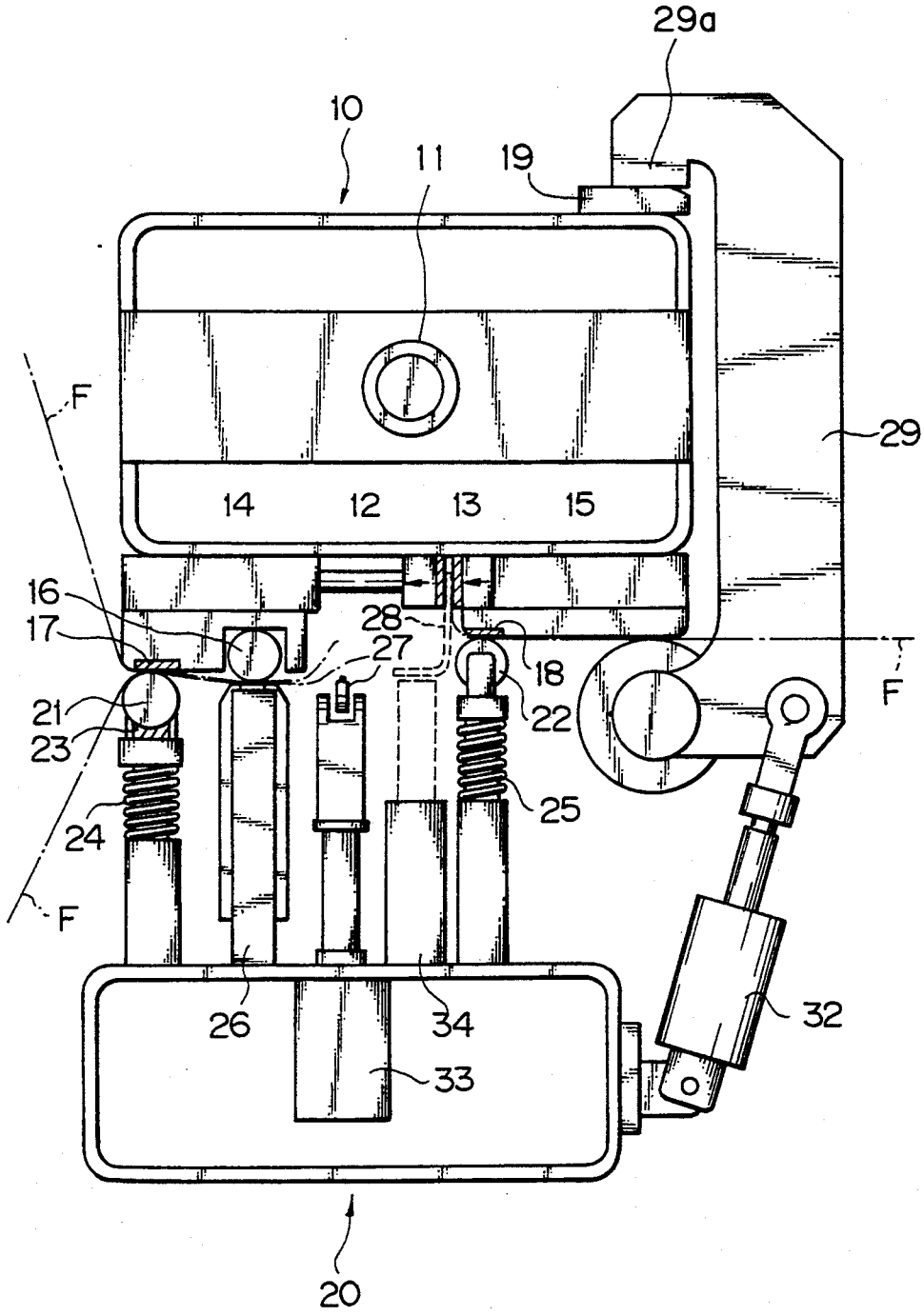
Figure 14:
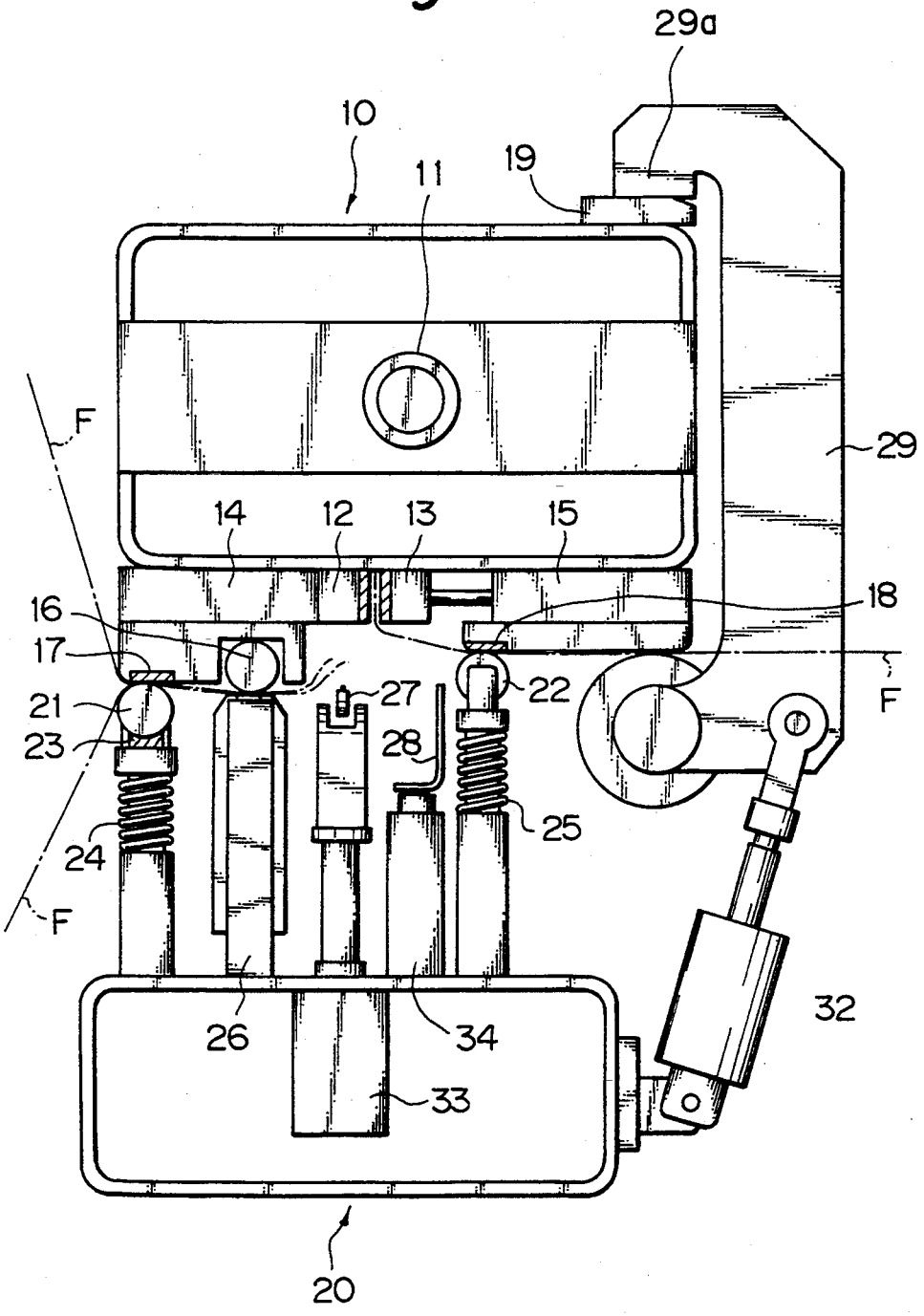

The gripping finger 12 is then moved toward the gripping finger 13 to the second position by the actuation of the pneumatic cylinder 14, to grip the free end of the film F which is pushed by the pusher blades 28, as shown in FIG. 13. This free end is a leading end of the film F for the next cycle. The gripping fingers 12 and 13 are moved together to the first position by the actuation of the pneumatic cylinders 14 and 15, as shown in FIG. 14. The guide roller 22 holding the film F with the antislip portion 18 can rotate only in the direction of the feed of the film F and thus the film F can be pulled by the gripping fingers 12 and 13.

Figure 7H:
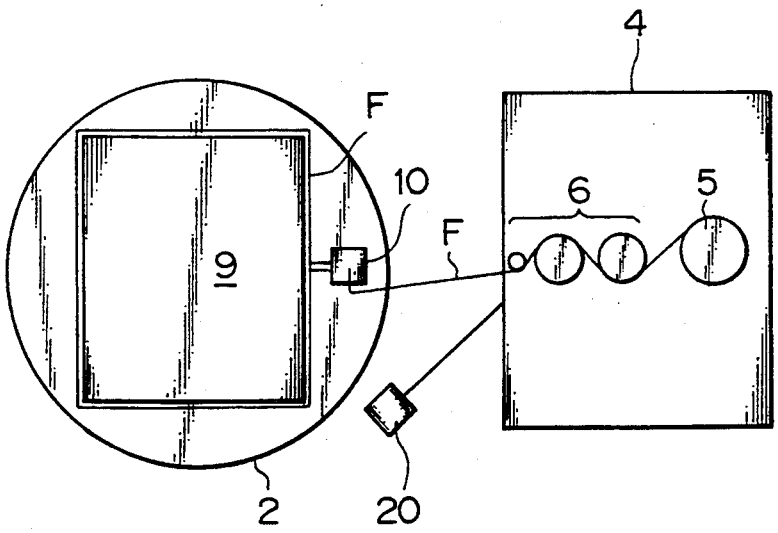

The air tube 16 is then shrunk by releasing the air pressure therefrom. The locking taper cone 8 is moved upwardly by the actuation of the pneumatic cylinder 35 and the chuck 29 is moved to the initial position by the actuation of the pneumatic cylinder 32 to release the engagement of the swing arm device 20 with the gripper device 10. The swing arm device 20 is then returned to the initial position by the actuation of the pneumatic cylinder 31, to release the heatsealed ends of the film F from the guide roller 21. In this way, the load 9 is wrapped by the stretching film F only in one turn of the film F. This condition is shown in FIG. 7H.

The top platen 7 is then returned to the initial position by the actuation of the pneumatic cylinder 31. The conveyor 3 is then automatically started to transfer the stretch-wrapped load 9 upon receipt of a "ready to receive" signal from an apparatus on the downstream side. The automatic stretch-wrapping cycle is thus completed.

It is possible to adhere the heatsealed ends of the film F projecting from the stretch-wrapped load 9 to the outer surface of the stretch-wrapped load 9 to facilitate the handling of the stretch-wrapped load 9 (refer to Japanese Examined Utility Model Publication (Kokoku) No. 63-23298).

It is possible to design the present apparatus so that the diameter of the turntable 2 and the width and/or depth of the apparatus are identical to those of the prior art apparatus to handle a load having a dimension similar to that of a load handled in the present apparatus. It is, therefore, possible to adapt the present apparatus to the conventional layout of the line, and thus it is not necessary to substantially change the layout and to save cost if the present apparatus is used in place of the prior art apparatus.

FIGS. 15 to 18 shown the second embodiment according to the present invention. The stretch-wrapping apparatus of this embodiment comprises, similar to the previous embodiment, a base frame 1, turntable 2 having a conveyor 3, a film support frame 4, a gripper device 10 rotatably arranged on the turntable 2, and a swing arm device 20. Also similar to the previous embodiment, the support frame 4 has means 5*a* for supporting a roll 5 of stretchable film F in a vertical position, the gripper device 10 has a plurality of pairs of gripping fingers 12 and 13, and the swing arm device 20 comprises pusher blades 28, a heatsealer 27 and a cutter 27. The detailed description of these elements are omitted here because these elements has been described in greater details with reference to FIGS. 1 to 14.

The support frame 4 has film tensioning means 6 for tensioning the film F supplied from the roll 5 of film. The present embodiment improves the film tensioning means 6. In the previous embodiment, the film tensioning means 6 comprises two cylindrical rollers; the downstream roller is driven faster than the upstream roller to stretch the film F therebetween in one direction. There is a problem that the thin film F may be torn if the film is stretched in one direction. For example, referring to FIG. 19, the load 9 does not have a smooth shape and there are local projections such as separate sheets 9*b*. The film F is apt to be torn at the positions of the separate sheet 9*b*. According to the inventor's observation, the sealed portion 9*f* of the film F is especially apt to be torn. The present invention is intended to solve this problem.

As shown in FIGS. 15 to 18, the tensioning means 6 comprises a brake roller 61 incorporating a magnetic brake 68 arranged on the downstream side of the roll 5 of film F, a pair of disk rollers 62 and 63 having disks 62*d* and 63*d* so arranged on the downstream side of the brake roller 61 as staggered between each other, and a cylindrical roller 65 arranged on the downstream side of the disk rollers 62 and 63. A sensor roller 67 is arranged on the downstream side of the cylindrical roller 65 for detecting the speed of the film F delivered from the tensioning means 6 and a nip roller 66 is arranged on the sensor roller 67 to nip the film F without slip on the sensor roller 67. A guide roller 64 is arranged between the disk roller 62 and the cylindrical roller 65. In addition, an AC servo-motor 69 is arranged to drive the disk rollers 62 and 63 and the cylindrical roller 65.

The brake roller 61 incorporating the magnetic brake 68 limits the feed of the film delivered from the roll 5 of film F and serves to tension the film F to some extent. The disk rollers 62 and 63 are rotatably arranged at a close relationship to each other so that the disks 62*d* and 63*d* partly overlap each other. The disk rollers 62 and 63 have eccentric gears 62*a* and 63*a* attached thereto, respectively, the eccentric gears 62*a* and 63*a* being engaged with each other so that the disk rollers 62 and 63 rotate in synchronism with each other but eccentrically in opposite phase in reversed directions.

Also, the disk roller 62 and the cylindrical roller 65 have sprockets 62*b* and 65*b* attached thereto, respectively, and the AC servo motor 69 has a sprocket 69*b*. A chain 70 runs around the sprockets 69*b*, 62*b*, and 65*b*. Accordingly, the cylindrical roller 65, the disk roller 62, and the disk roller 63 connected to the disk roller 62 by the eccentric gears 62*a* and 63*a* are driven by the AC servo motor 69. The disk rollers 62 and 63 are driven at the same average peripheral speed (but in reversed directions). The cylindrical roller 65 is driven at a speed identical to or faster than the speed of the disk roller 62. Preferably, the cylindrical roller 65 is driven at a peripheral speed faster than the peripheral speed of the load 9 on the turntable 2.

The sensor roller 67 is brought in contact with the film F, which is instantaneously shrunk by the relaxation of the stress between the faster cylindrical roller 65 and the slower load 9, and detects the variation of the speed of the film F from the variation of the speed thereof. The AC servo motor 69 is controlled in response to the output of the cylindrical roller 65.

The film F is first braked by the brake roller 61 and passes between the disk rollers 62 and 63 which drive the film F. The film F is forced in a zigzag manner in a gap between two disks 62*d* (63*d*) of one disk roller 62 (63) by the disk 63*d* (62*d*) of the other disk roller 63 (62) and reversely in a gap between two disks 63*d* (62*d*) of one disk roller 63 (62) by the disk 62*d* (63*d*) of the other disk roller 62 (63). Accordingly, the film F is stretched not only in the transverse direction of the film F, but also locally in the longitudinal direction of the film F, by the disks 62*d* and 63*d* which are driven at the uneven speed. Thereafter, the film F is further stretched between the cylindrical roller 65 driven at a speed identical to or faster than the speed of the disk roller 62 and the disk rollers 62 and 63, and the width of the film F is substantially restored to the initial width. The film F shrinks instantaneously when it leaves the disk rollers 62 and 63 and then is stretched uniformly along the longitudinal direction. As a result, the molecular structure of the film is aligned at various portions at various angles close to the longitudinal direction of the film F, and alignments may be mixed.

Accordingly, the film F has a sufficient strength in the longitudinal direction as well as in the other directions, and it is possible to reduce the tendency of the film to tear.

FIGS. 20 to 24 show the third embodiment of the present invention. This embodiment improves the gripper device 10 and the swing arm 20 of the first embodiment of FIGS. 1 and 2. Thus the gripper device 10 is rotatably arranged on the turntable 2 around the central axis of the gripper device 10, and the swing arm device 20 can be moved toward and away from the gripper device 10.

The gripper device 10 includes pairs of cooperation gripping fingers 12 and 13 with pneumatic cylinders 14 and 15, at the horizontally central region of the front surface, an air tube 16 (as a backup member for the heatsealer) arranged on the side of the gripping fingers 12 and 13 near the turntable 2 to receive and cooperate with a heatsealer 26 arranged on the swing arm device 20, a first antislip portion 17 arranged on the outer side of the air tube 26 remote from the gripping fingers 12 and 13, and a second antislip portion 18 on the outer side of the gripping fingers 12 and 13 remote from the air tube 26.

The swing arm device 20 comprises pusher blades 28, to push the film F between the opposite gripping fingers 12 and 13 of the gripper device 10, an impulse heatsealer 26 to cooperate with the air tube 16, a hot wire cutter 27 arranged between the pusher blades 28 and the heatsealer 26, a first row of vertically extending guide rollers 21 on the outer side of the heatsealer 26 remote from the pusher blades 28 for engagement with the first antislip portion 17, and a second row of vertically extending guide rollers 22 on the outer side of the pusher blades 28 remote from the heatsealer 26 for engagement with the second antislip portion 18.

In this embodiment, the swing arm device 20 includes a second vertically extending pusher blade 42 between the heatsealer 26 and the first guide rollers 21, and the gripper device 10 includes a vertically extending groove 43 between the air tube 26 and the first antislip portion 17, so that the second pusher blade 42 faces the groove 43 and can advance into the groove 43 when it is actuated. To this end, the second pusher blade 42 is operatively connected to a pneumatic cylinder 44.

In operation, when the load reaches the center of the turntable 2, the gripper device 10 is initially rotated relative to the turntable 2 about the second central axis by 360 degrees, and the turntable 2 is then rotated about the first central axis by 360 degrees, as described with reference to FIGS. 7A to 7F. The swing arm device 20 is then pivotally moved toward the gripper device 10, as shown in FIG. 7G.

Figure 20:
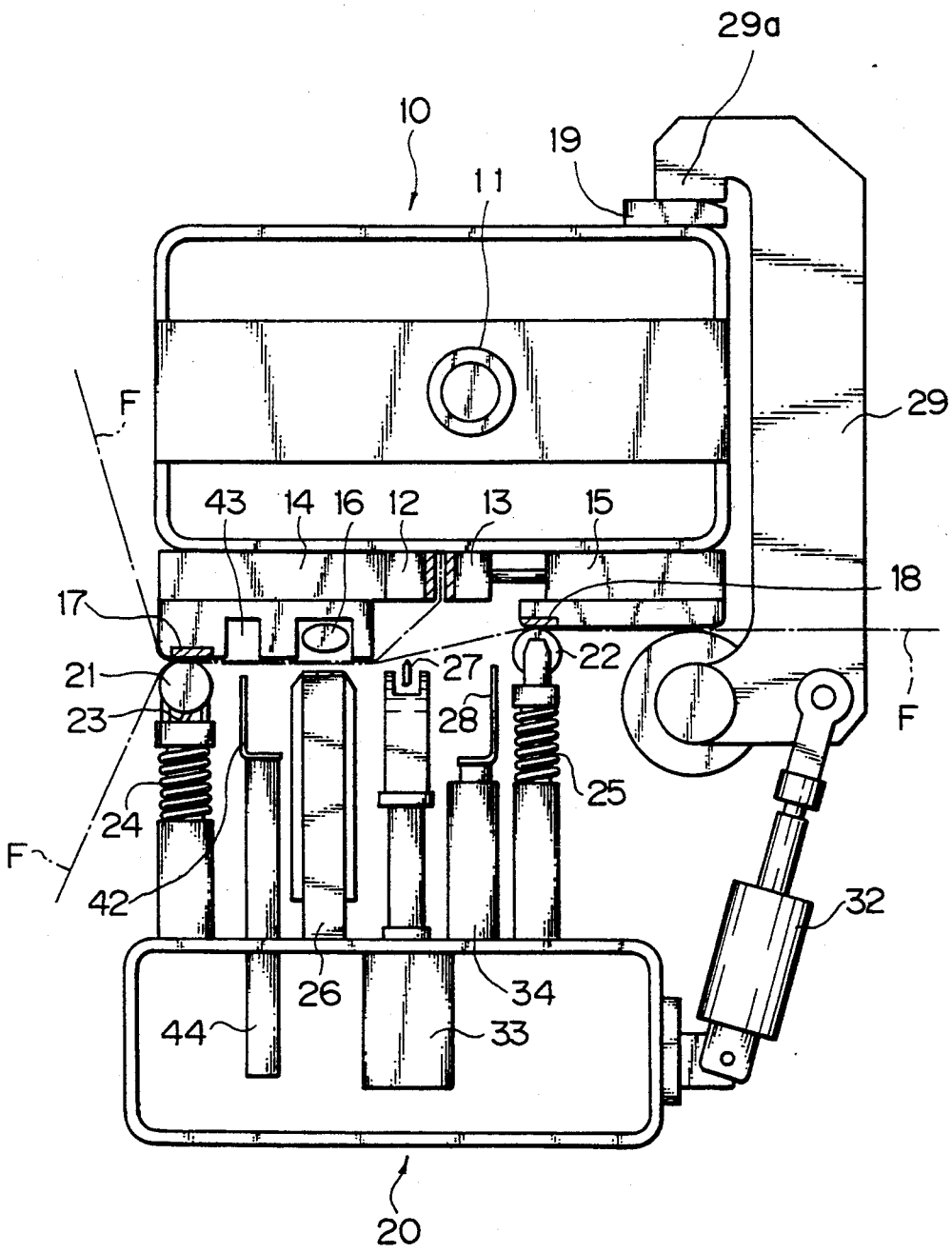
FIGS. 20 to 24 are views of an automatic stretch-wrapping apparatus according to the third embodiment of the present invention and illustrating the sequential operation of the gripper device and the swing arm device.

This condition is shown in FIG. 20, which corresponds to FIG. 8. The leading end of the film F is gripped by the gripping fingers 12 and 13, and the trailing end of the loop of the film F wound around the load 9 is held between the guide rollers 21 and 22 and the antislip portions 17 and 18, as described above, so that the film does not move.

Figure 21:
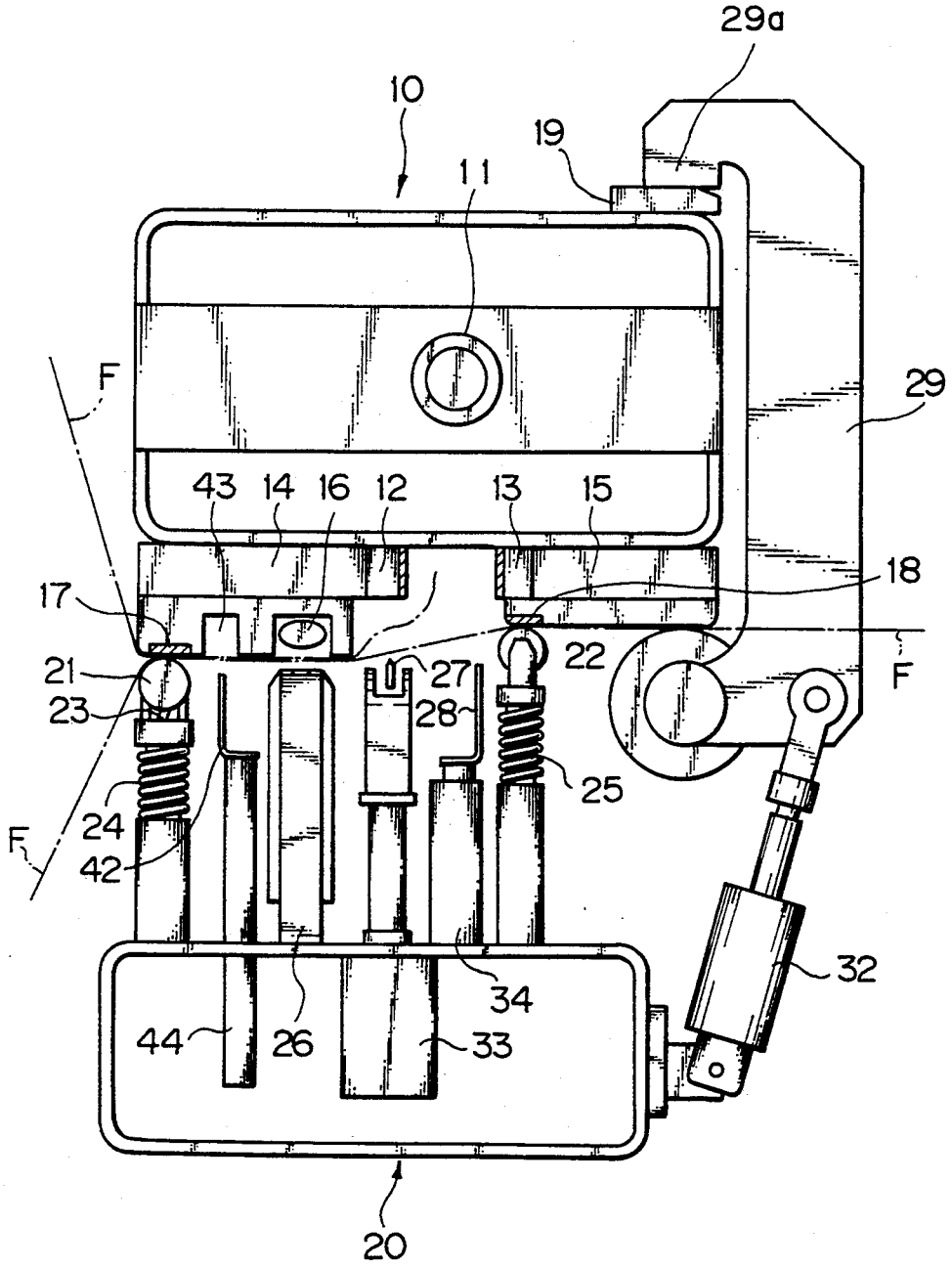
Figure 22:
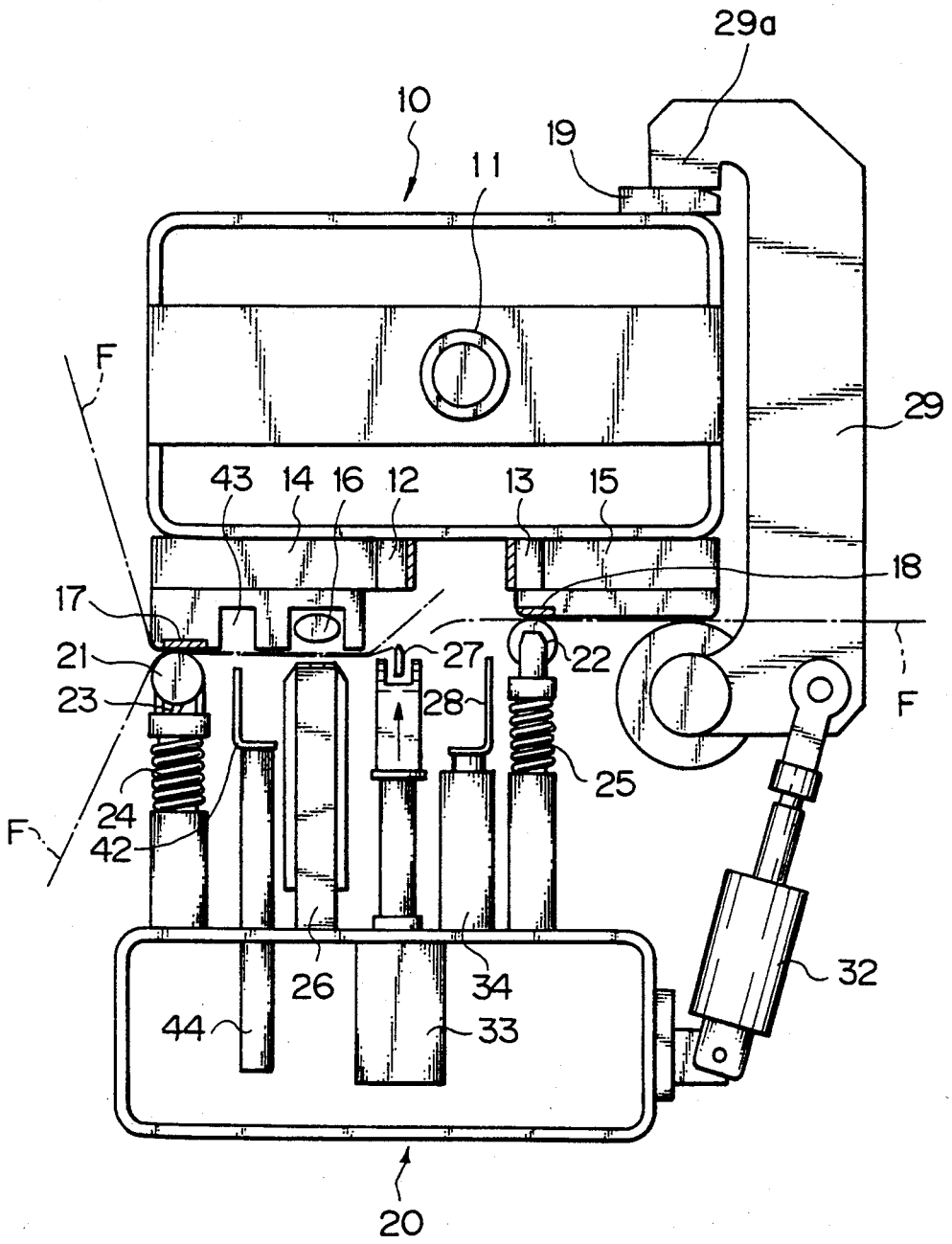

The gripping finger 13 is then moved to the second (right) position to release the leading end of the film F from the gripper device 10, as shown in FIG. 21 (corresponding to FIG. 9). The hot wire cutter 27 is then supplied with a current and advanced toward the film F to cut the film F, as shown in FIG. 22 (corresponding to FIG. 10). The hot wire cutter 27 is retracted after the film F is cut. One portion of the cut film F is held between the guide rollers 21 and the antislip portion 17, and the other portion of the cut film F is held between the guide rollers 22 and the antislip portion 18.

Figure 23:
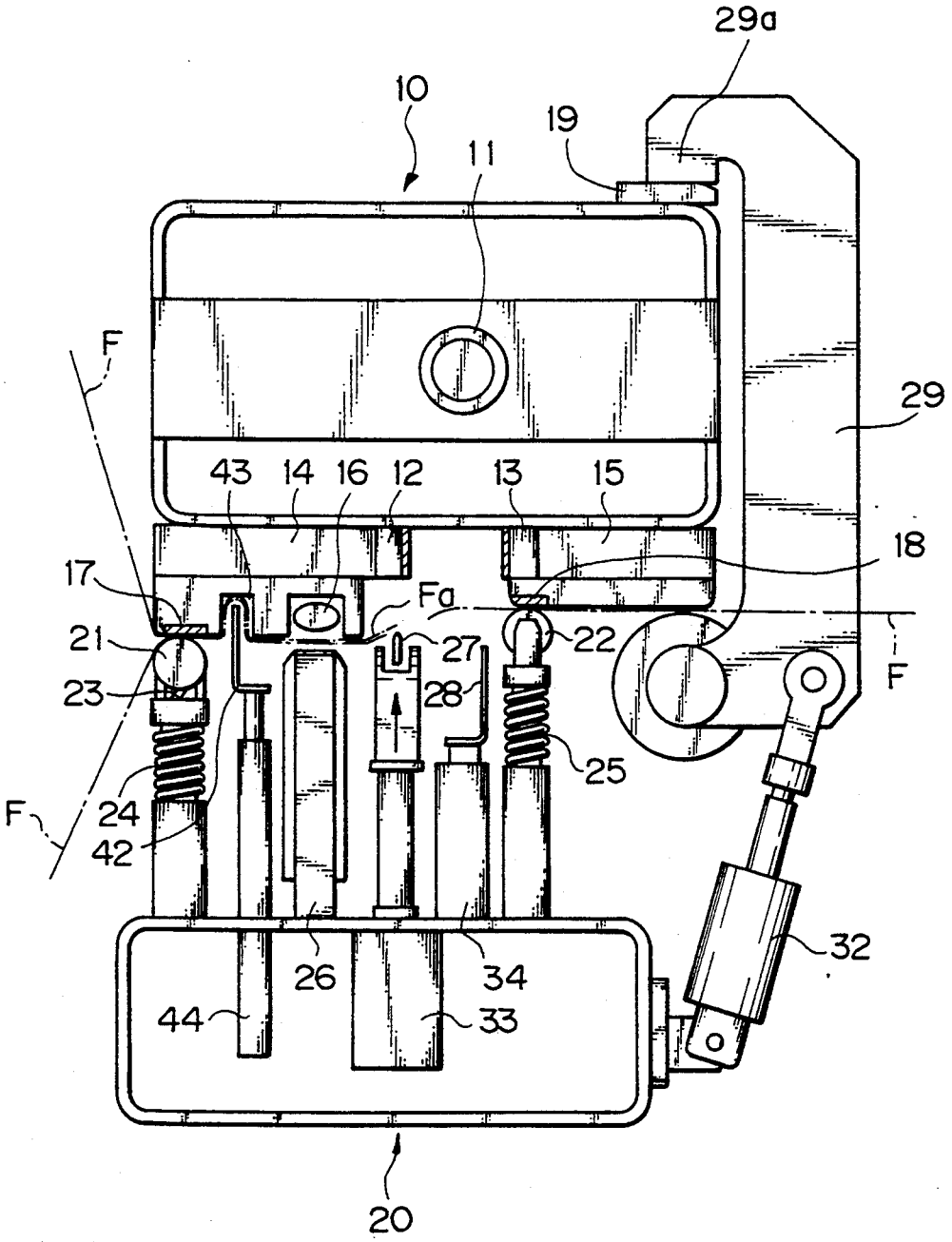

The second pusher blade 42 is then advanced towards the groove 43, pushing the portion of the cut film F, held between the guide rollers 21 and the antislip portion 17, into the groove 43, as shown in FIG. 23. Accordingly, the trailing end Fa of the cut film F moves to the left in FIG. 23, resulting that the length of the film F between the trailing end Fa of the cut film F and a portion of the film F pinched by the heatsealer 26 and the air tube 16 is shortened, compared with the corresponding length of the free end portion of FIG. 22.

Figure 24:
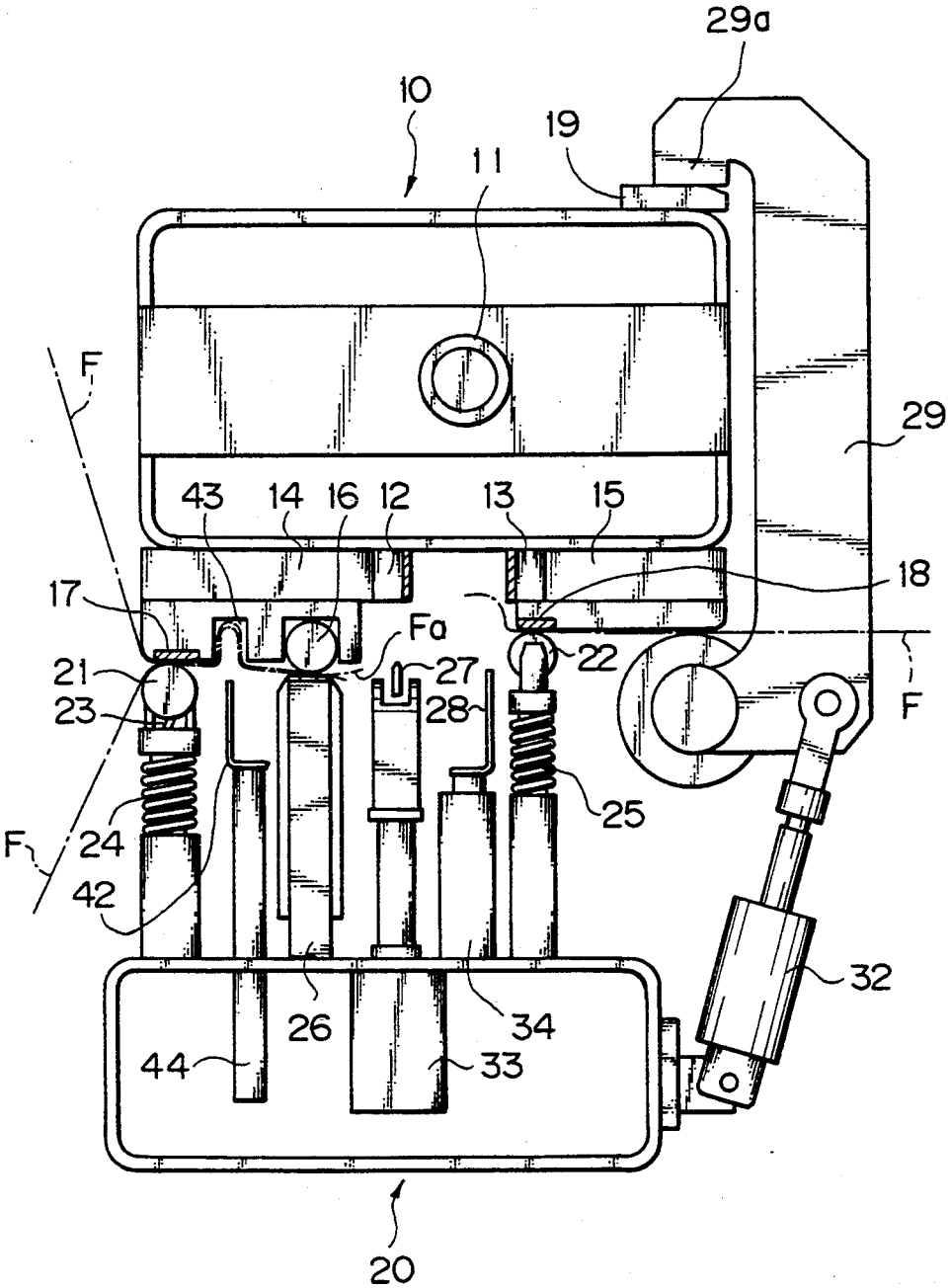

The air tube 16 is then inflated with air and the impulse heatsealer 26 is supplied with a current, to heatseal the leading end portion of the loop of the film F wound around the load 9 and the trailing end portion of the loop of the film F together, as shown in FIG. 24 (corresponding to FIG. 11). Note, the length of the film F between the trailing end Fa of the cut film F and a portion of the film F pinched by the heatsealer 26 and the air tube 16 becomes an excess portion of the loop after the heatseal is carried out. According to this embodiment, it is possible to shorten the excess portion outside the loop of film F.

The subsequent operation is carried out similarly to the first embodiment. The first pusher blades 28 are then advanced toward a position between the gripping fingers 12 and 13 to push a free end of the portion of the film F which is held between the guide rollers 22 and the antislip portion 18, as described with reference to FIG. 12. The gripping finger 12 is then moved toward the gripping finger 13 to the second position (FIG. 13), and the gripping fingers 12 and 13 are moved together to the first position (FIG. 4). The air tube 16 is then shrunk. The swing arm device 20 is then returned to the initial position (FIG. 7H).

Although the present invention has been described regarding the specific embodiments, it will be understood that it is possible to modify the elements, or to change the shape and the number of the elements of the apparatus within the scope and spirit of the present invention.

We claim:

1. An automatic stretch-wrapping apparatus comprising:

a base frame;

a turntable arranged on said base frame for rotation about a first vertical axis, said turntable having a conveyor for transferring a load to be wrapped to and from said apparatus;

a film support frame arranged on said base frame adjacent to said turntable, said support frame having a means for supporting a roll of stretchable film in a vertical position and film tensioning means;

a gripper device arranged on said turntable at a relatively outer region of said turntable, said gripper device comprising a vertically extending post rotatable relative to said turntable about a second axis parallel to said first axis and having a first surface, a plurality of pairs of cooperating gripping fingers arranged on the first surface of said post so that said gripping fingers of each pair are in a horizontally opposed relationship and the pairs are in a vertical row for receiving therebetween the film supplied from said roll of film via said film tensioning means so that the film gripped by said gripping fingers is wound around a load on the turntable when said gripper means rotates around said first axis, and a backup means on said first surface; and a swing arm device arranged outside the turntable, said swing arm device comprising at least one swing arm having one end pivotally supported about a third axis parallel to said first axis and a second end for movement toward and away from said gripper device, and a post attached to the second end of the swing arm, said post having a second surface facing said first surface of said gripper device when said post is moved toward said gripper device, said post of said swing arm device including on said second surface thereof:

a plurality of vertically spaced pusher elements which are arranged vertically between two adjacent pairs of said gripping fingers and horizontally between the opposite gripping fingers of each pair, when said swing arm device is moved toward said gripper device and when said gripping fingers are opened, for pushing the film into a gap between said gripping fingers of each pair, to allow said gripping fingers to grip the film;

a heatsealer arranged on the second surface of the swing arm device with the pusher elements for heatsealing a leading portion of the film wound around the load with trailing portion of the film wound around the load in cooperation with the backup means; and a cutter arranged between the pusher elements and the heatsealer for cutting the film.

2. An apparatus according to claim 1, wherein said roll of film has a width substantially equal to or greater than a height of a load to be wrapped, so that the load is fully wrapped along the height thereof in one turn of the film.

3. An apparatus according to claim 1, wherein said roll of film has a width greater than a height of a load to be wrapped, and said gripping fingers of said gripper device can grip a leading edge of the film along the full width of the film.

4. An apparatus according to claim 1, wherein both of said gripping fingers of each pair are horizontally movable toward and away from each other between a first position and a second position, and said pusher elements are arranged horizontally between the opposite gripping fingers of each pair, respectively, when said gripping fingers are in one of said first and second positions.

5. An apparatus according to claim 1, wherein said backup means comprises a vertically extending air tube.

6. An apparatus according to claim 1, wherein said gripper device is arranged on said turntable at a relatively outer region of said turntable at a position substantially on a line connecting said first axis and said film tensioning means when said turntable is in an initial position of the turntable;

said vertically extending post of said gripper device has side surfaces and a back surface;

said first surface extending generally parallel to said line when said turntable is in said initial position of the turntable and said gripper device is in an initial position of the gripper device whereby the film extending from said tensioning means and gripped by said gripper device initially rests on said first surface; and said gripper device being initially rotated relative to said turntable about said second axis by 360 degrees from said initial position of the gripper device whereby the film rests on said first surface, one of the side surfaces near the first axis, and said back surface of said post, said turntable with said gripper device being then rotated about said first axis by 360 degrees from said initial position of the turntable to cause the film to be wound around the load while the film rests on said side surface near the load and thus said gripper device is positioned outside of a loop of film formed around the load.

7. An apparatus according to claim 6, wherein said gripper device includes at said first surface thereof at least one pair of cooperating gripping fingers at a horizontally central region thereof, said backup means arranged on the side of said gripping fingers near said first axis to receive and cooperate with said heatsealer means, a first antislip portion vertically extending on the outer side of said backup means remote from said gripping fingers, a second antislip portion vertically extending on the outer side of said gripping fingers remote from said backup means; and said swing arm post has a front surface directed to the front surface of said gripper device, said swing arm includes at said front surface thereof said pusher elements for pushing the film toward said gripper device, said heatsealer for engagement with said backup means, said cutter between said pusher elements and said heatsealer, first at least one vertically extending guide roller on the outer side of said heatsealer remote from said pusher elements for engagement with said first antislip portion, and second at least one vertically extending guide roller on the outer side of said pusher elements remote from said heatsealer for engagement with said second antislip portion.

8. An apparatus according to claim 7, wherein said first guide roller is constructed to cooperate with a brake and said second guide roller is constructed to rotate in one direction only.

9. An apparatus according to claim 7, wherein said backup means comprises a vertically extending air tube.

10. An apparatus according to claim 7, wherein a locking element is arranged on said film support frame for upward and downward movement to engage with said post of said gripper device.

11. An apparatus according to claim 1, wherein a top platen is arranged on said film support frame for upward and downward movement to engage with the load on the turntable to hold the load in position.

12. An apparatus according to claim 1, wherein said film tensioning means of said film support frame comprises a drive roller stretching mechanism comprising at least two rollers driven at different peripheral speeds from each other to stretch the film between said rollers.

13. An apparatus according to claim 12, wherein detecting means is provided for detecting the speed of the film delivered from said drive roller stretching mechanism and the speed of the film is controlled in response to an output of said detecting means.

14. An apparatus according to claim 1, wherein said film tensioning means of said film support frame comprises a brake roller incorporating a magnetic brake.

15. An apparatus according to claim 1, wherein said film tensioning means of said film support frame comprises a brake roller incorporating a magnetic brake arranged on the downstream side of said roll of stretchable film, a pair of disk rollers having disks so arranged as staggered between each other for passing the film therebetween and arranged on the downstream side of said brake roller, and a cylindrical roller on the downstream side of said disk rollers.

16. An apparatus according to claim 15, wherein said disk rollers are driven commonly at a first speed in average, and said cylindrical roller is driven at a second speed faster than said first speed.

17. An apparatus according to claim 16, wherein said disk rollers have eccentric gears attached thereto, respectively.

18. An apparatus according to claim 6, wherein said gripper device includes at said first surface thereof at least one pair of cooperating gripping fingers at a horizontally central region thereof, said backup means arranged on the side of said gripping fingers near said first axis to receive and cooperate with said heatsealer, a first antislip portion vertically extending on the outer side of said backup means remote from said gripping fingers, a second antislip portion vertically extending on the outer side of said gripping fingers remote from said backup means, and a vertically extending groove between the backup means and the first antislip portion; and said swing arm post has a front surface directed to the first surface of said gripper device, said swing arm includes at said front surface thereof said pusher elements for pushing the film toward said gripper device, said heatsealer for engagement with said backup means, said cutter between said pusher elements and said heatsealer, first at least one vertically extending guide roller on the outer side of said heatsealer remote from said pusher elements for engagement with said first antislip portion, second at least one vertically extending guide roller on the outer side of said pusher elements remote from said heatsealer for engagement with said second antislip portion, and a second vertically extending pusher elements between the heatsealer and the first guide roller for pushing the film toward said groove to shorten an excess portion outside the loop of film F wrapping the load.

19. An automatic stretch-wrapping apparatus comprising:

a base frame;

a turntable arranged on said base frame for rotation about a first vertical axis, said turntable having a conveyor for transferring a load to be wrapped to and from said apparatus;

a film support frame arranged on said base frame adjacent to said turntable, said support frame having a means for supporting a roll of stretchable film in a vertical position and film tensioning means;

gripper means arranged on said turntable at an outer region of said turntable and comprising at least a pair of cooperating gripping fingers for receiving therebetween the film supplied from said roll of film via said film tensioning means so that the film gripped by said gripper means is wound around a load on the turntable while the turntable with said gripper means rotates around said first axis;

means for rotating said gripper means about a second axis parallel to said first axis; and swing arm means pivotally supported about a third axis parallel to said first axis for movement toward and away from said gripper means, said swing arm means including:

pusher means for pushing the film toward said gripping fingers of said gripper means;

heatsealer means for heatsealing a leading portion of the film wound around the load with another portion of the film; and cutting means for cutting the film between said gripper means and said heatsealer means.

20. An apparatus according to claim 19, wherein said roll of film has a width substantially equal to or greater than a height of a load to be wrapped, so that the load is fully wrapped along the height thereof in one turn of the film.

21. An apparatus according to claim 19, wherein said gripper means includes a vertically extending post having a front surface directed to said swing arm means and a plurality of pairs of cooperating gripping fingers arranged on the front surface of said post so that said gripping fingers of each pair are in a horizontally opposite relationship and the pairs are in a vertical row.

22. An apparatus according to claim 21, wherein said pusher means comprises a plurality of vertically spaced pusher elements which are arranged vertically between two adjacent pairs of said gripping fingers and horizontally between the opposite gripping fingers of each pair, respectively, whereby when said pusher means with said swing arm means is moved toward said gripper means, the film can be pushed between the opposite gripping fingers of each pair, allowing the opposite gripping fingers to move toward each other.

23. An apparatus according to claim 21, wherein said post has backup means at said front surface to receive and cooperate with said heatsealer means to heatseal the film between said heatsealer means and said backup means, said backup means extending vertically parallel to said row of gripping fingers.

* * * * *